US005148783A

United States Patent [19]

Shinkai et al.

[11] Patent Number: 5,148,783

[45] Date of Patent: Sep. 22, 1992

[54] VALVE ACTUATING MECHANISM IN FOUR-STROKE CYCLE ENGINE

[75] Inventors: Tatsuya Shinkai, Hamamatsu; Kazuhiko Suzuki; Younosuke Yokogi, both of Shizuoka, all of Japan

[73] Assignee: Suzuki Kabushiki Kaisha, Shizuoka, Japan

[21] Appl. No.: 664,273

[22] Filed: Mar. 4, 1991

[30] Foreign Application Priority Data

Mar. 8, 1990 [JP] Japan ..... 2-22617[U]
Mar. 23, 1990 [JP] Japan ..... 2-71981
Mar. 27, 1990 [JP] Japan ..... 2-75477

[51] Int. Cl.[5] ..... F01L 1/34
[52] U.S. Cl. ..... 123/90.16; 123/90.17
[58] Field of Search ..... 123/90.15, 90.16, 90.17

[56] References Cited

U.S. PATENT DOCUMENTS

| | | | |
|---|---|---|---|
| 4,397,270 | 8/1983 | Aoyama | 123/90.16 |
| 4,638,773 | 1/1987 | Bonvallet | 123/90.16 |
| 4,643,141 | 2/1987 | Bledsoe | 123/90.16 |
| 5,018,487 | 5/1991 | Shinkai | 123/90.16 |
| 5,025,761 | 6/1991 | Chen | 123/90.16 |

FOREIGN PATENT DOCUMENTS

| | | | |
|---|---|---|---|
| 148910 | 11/1980 | Japan | 123/90.16 |
| 193705 | 11/1982 | Japan | 123/90.17 |

OTHER PUBLICATIONS

Japanese Utility Model Publication No. 55-152308, 1980.

*Primary Examiner*—E. Rollins Cross
*Assistant Examiner*—Weilun Lo
*Attorney, Agent, or Firm*—Finnegan, Henderson, Farabow, Garrett and Dunner

[57] ABSTRACT

A valve actuating mechanism is disposed within a four-stroke cycle engine and comprises a rotatable rocker shaft having eccentric large-diameter portions formed as bushings upon the rocker shaft, a rocker arm assembly including a first rocker arm rotatably mounted directly upon the rocker shaft and second and third rocker arms rotatably muonted upon the eccentric bushings of the rocker shaft with the first rocker arm being interposed between the second and third rocker arms, and a cam assembly including first, second and third cam members which drives the first, second and third rocker arms, respectively. The first rocker arm is provided with a branched distal end and the second and third rocker arms are each provided with a distal end which is laid upon each of the distal ends of the first rocker arm. The second and third cams have the same cam profile and the first cam has a cam profile which is different from that of the second and third cams. A play adjusting screw means is provided for either one of the support portions of the first rocker arm and the second and third rocker arms and a screw receiving portion is provided upon the other one of the support portions of the first rocker arm and the second and third rocker arms in such a manner that a clearance is defiend between a distal end of the play adjusting means and the screw receiving portion is adjusted.

20 Claims, 13 Drawing Sheets

VALVE ACTUATING MECHANISM IN FOUR-STROKE CYCLE ENGINE

FIELD OF THE INVENTION

The present invention relates to a valve actuating mechanism disposed within a four-stroke cycle engine which is capable of varying, for example, the lift and the timing for the opening operation of intake-exhaust valves in accordance with operating conditions of the engine and vehicle.

BACKGROUND OF THE INVENTION

Usually, a four-stroke cycle engine to be mounted upon a vehicle such as, for example, an automobile and a motorcycle is provided with intake-exhaust valves above the combustion chamber thereof. These valves are driven by means of a valve actuating mechanism. Specifically, the valve actuating mechanism is provided with a cam shaft which is operated in association with the crankshaft of the engine so that the intake-exhaust valves are caused to move in an up and down mode at a predetermined time by means of a cam which is formed upon such cam shaft.

It is desirable for a four-stroke cycle engine that a high output may be obtained for a broad speed range extending from a low speed range to an intermediate-high speed range, that is, that the power band be wide.

In a conventional valve actuating mechanism, however, since the timing for the opening-closing of a valve and the amount of the lift are fixed, only an output characteristic having a peak value within a specific engine speed range may be obtained and one is forced to make a choice as to whether the output characteristic within the low speed region is to be emphasized or the output characteristic within the intermediate-high speed range is to be emphasized.

OBJEOTS OF THE INvENTION

A primary object of the present invention is to substantially eliminate the defects or drawbacks encountered within the prior art and to provide a valve actuating mechanism within a four-stroke cycle engine which is capable of improving the output within a broad speed range while it is possible to reduce the holding force which is necessary after a predetermined rotation of the rocker shaft so as to hold the rocker shaft at a predetermined stopping position.

Another object of the present invention is to provide a valve actuating mechanism within a four-stroke cycle engine which is capable of preventing a stopper pin from falling out of an eccentric large-diameter bushing portion formed upon the rocker shaft of the valve actuating mechanism and improving the strength thereof.

A further object of the present invention is to provide a valve actuating mechanism within a four-stroke cycle engine which is capable of preventing the occurrence of striking noise which is possibly developed between a cam which is not driving one rocker arm and another rocker arm which is not being driven by means of a cam and is in its floating state.

SUMMARY OF THE INvENTION

These and other objects of the present invention can be achieved by providing, in accordance with one aspect thercof, a valve actuating mechanism disposed within a four-stroke cycle engine in which exhaust and intake valves are disposed and comprising a rocker shaft rotatably supported upon a cylinder head of an engine unit and having eccentric large-diameter bushing portions formed upon the rocker shaft, rocker arm means including a first rocker arm rotatably mounted directly upon the rocker shaft and second and third rocker arms rotatably mounted upon the eccentric large-diameter bushing portions of the rocker shaft with the first rocker arm being interposed between the second and third rocker arms, and cam means including first, second and third cam members which drive the first, second and third rocker arms, respectively, the first rocker arm being provided with a branched distal end and the second and third rocker arms each being provided with a distal end which are disposed upon the distal ends of the first rocker arm, respectively, the second and third cams having the same cam profiles while the first cam has a cam profile which is different from those of the second and third cams.

In a preferred embodiment, the rocker shaft is rotated so that the axes of the eccentric large-diameter portions, which may constitute the eccentric bushings, of the rocker shaft are movable within one half portion of the rocker shaft between a diagonally inward limit and a diagonally outward limit which is the limit of the movement of the axes of the bushings where the second and third cams are caused to drive the second and third rocker arms, the movable outward limit being set at a position beyond the dead points of the eccentric large-diameter portions.

A play adjusting screw means is provided for either one of the support portions of the first, second and third rocker arms and a screw means receiving portion is provided for another one of the support portions of the first rocker arm and the support portions of the second and third rocker arms in such a manner that a clearance defined between a distal end of the play adjusting means and the screw receiving portion is adjustable.

The branched distal ends of the first rocker arm are operatively connected to the exhaust and intake valves disposed within the engine.

In accordance with another aspect of the present invention, there is provided a valve actuating mechanism disposed within a four-stroke cycle engine in which exhaust and intake valves are disposed, and comprising a rocker shaft rotatably supported upon a cylinder head of an engine unit and having eccentric large-diameter portions formed upon the rocker shaft and a pin insertion hole, rocker arm means including a first rocker arm rotatably mounted directly upon the rocker shaft and second and third rocker arms rotatably mounted upon the eccentric large-diameter portions of the rocker shaft with the first rocker arm being interposed between the second and third rocker arms, and cam means including first, second and third cam members which drive the first, second and third rocker arms, respectively, the second and third cams having the same cam profiles while the first cam has a cam profile which is different from those of the second and third cams, the eccentric large-diameter portions each being provided with an eccentric bushing having a thick top portion and a pin insertion hole formed within the thick top portion, and with a stopper pin to be inserted into the pin insertion hole of the eccentric bushing and the rocker shaft so as to rotate the rocker shaft while maintaining the thick top portion of the bushing at a predetermined angular position defined upon one half side portion of the rocker shaft. The branched distal ends of the first rocker arm are operatively connected to the exhaust and intake valves disposed within the engine.

According to the characteristics of the valve actuating mechanism of the present invention, disposed within a four-stroke cycle engine, the rocker shaft is rotated by means of a predetermined angle so as to rotate the eccentric large-diameter portions thereof so that the cam follower surfaces formed upon the second and third rocker arms and operative in connection with the second and third cams are changed in position with respect to the cam follower surface of the first rocker arm. When the cam follower surfaces formed upon the second and third rocker arms in connection with the second and third cams is changed downwardly in position with respect to the cam follower surface of the first rocker arm, the contact defined between the second and third rocker arms and the second and third cams is released so as to bring the first rocker arm and the first cam into contact with each other so that the exhaust or intake valve of the four-stroke cycle engine is driven by means of the first cam.

On the other hand, when the cam follower surfaces of the second and third rocker arms are changed in position so as to be moved generally upwardly or to the same level with respect to the cam follower surface of the first rocker arm, the contact defined between the first rocker arm and the first cam is released so that the second and third rocker arms and the second and third cams are respectively brought into contact with each other whereby the valve of the engine is operated by means of the second and third cams. In this way, it is possible to improve the output of the engine for a broad speed range by selecting a particular cam through means of rotation of the rocker shaft.

Furthermore, when the rocker shaft is rotated so as to cause the axis of the eccentric large-diameter portions to move from the diagonally inward movable limit to the diagonally outward movable limit, and because the rocker shaft before reaching the dead point is to be rotated in the direction opposite to the direction toward which the eccentric large-diameter portions are stabilized, it is necessary that the rocker shaft is acted upon by means of a gradually increasing force. However, since, when the axis of the eccentric large-diameter portions is beyond such dead point, the rotating direction of the rocker shaft coincides with the direction toward which the eccentric large-diameter portions are stabilized, it is possible to rotate the rocker shaft by means of a small rotating force. If therefore the diagonally outward movable limit of the axis is set to a position beyond the dead point of the eccentric large-diameter portions, the holding force for holding the axis of the eccentric large-diameter portions at such diagonally outward movable limit may be reduced.

In a preferred example, since the clearance defined between the distal end of the play adjusting screw and the screw receiving portion is arranged to be adjustable, it is possible by adjusting this clearance to synchronize the rocker arm which is not currently driven by means of the cam and is disposed in its floating state, with the movement of the rocker arm which is driven by means of the cam. Therefore, it is possible to prevent the occurrence of the striking noise which is caused between the cam which is not driving the corresponding rocker arm and the rocker arm which is not driven by means of the corresponding cam and is therefore disposed in the floating state.

In accordance with another aspect of the present invention, since the rocker shaft is rotated with the thick top or large-diameter portion of the eccentric bushing always being positioned upon the upper half side portion of the rocker shaft and the stopper pin is inserted into the rocker shaft and the eccentric bushing so as to secure the eccentric bushing to the rocker shaft, the stopper pin cannot fall out of the eccentric bushing portion, even if the support portions of the second and third rocker arms become disconnected from the eccentric bushings during the sliding motion of the rocker arms in the axial direction of the rocker shaft when the shim disposed between the branched distal ends of the first rocker arm and the distal ends of the second and third rocker arms is adjusted.

Furthermore, since the pin insertion hole is formed within the thick top or large-diameter portion, but not within the thin, small diameter or other portions, of the eccentric bushing, the entire strength of the eccentric bushing can be maintained. In addition, the severe tolerance in manufacturing the members such as, for example, the rocker shaft which is required in a case where the insertion hole is formed within the thin or small-diameter portion of the eccentric bushing is not needed.

BRIEF DESCRIPTION OF THE DRAWINGS

For a better understanding of the present invention and to show how the same is carried out, reference is made, by way of preferred embodiments, to the accompanying drawings, in which like or corresponding parts throughout the several views are designated by similar reference characters, and wherein.

DESCRIPTION OF THE PREFERRED EMBODIMENTS

A first embodiment of the present invention will now be descried with reference to FIGS. 1 to 11.

Figure 2:
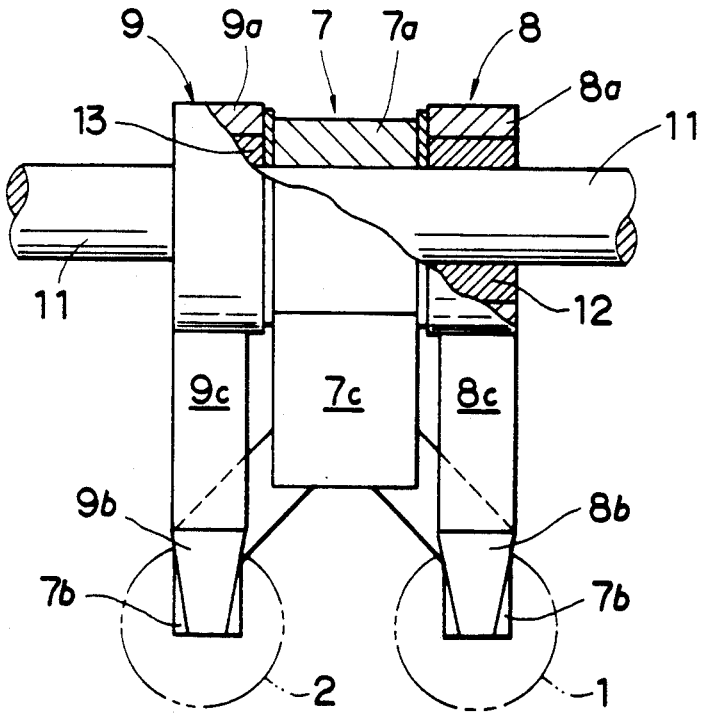
FIG. 2 is a plan view showing the valve actuating mechanism shown in FIG. 1.

Referring to FIG. 2 which is a perspective view showing a first embodiment of a valve actuating mechanism within a four-stroke cycle engine, the valve actuating mechanism is arranged both at the intake side and at the exhaust side of each cylinder of an engine. Accordingly, valves 1 and 2 are arranged to perform ingestion and exhaustion.

The valve actuating mechanism of this embodiment comprises a cam shaft 6 having a low speed cam 3 as a first cam as well as an intermediate-high speed cam 4 provided as a second cam and another intermediate-high speed cam 5 provided as a third cam which are arranged respectively upon opposite sides of the low speed cam, and a rocker shaft 11. The rocker shaft 11 is supported in a rotatable manner within a rocker shaft bearing portion 22 (FIG. 6) to be described later and is fitted with a low speed rocker arm 7 as a first rocker arm, an intermediate-high speed rocker arm 8 as a second rocker arm and another intermediate-high speed rocker arm 9 as a third rocker arm, which are provided below the cams 3, 4 and 5, respectively, and supporting portions 7*a*, 8*a* and 9*a* for the rocker arms 7, 8 and 9.

The distal end of the low speed rocker arm 7 is branched into two parts and the two branched ends 7*b* are in contact with the stem heads of the intake and exhaust valves 1 and 2, respectively, which open or close a combustion chamber of an engine, not shown. Furthermore, the supporting portion 7*a* of the low speed rocker arm 7 is mounted directly upon the rocker shaft 11 in a rotatable manner.

Figure 3:
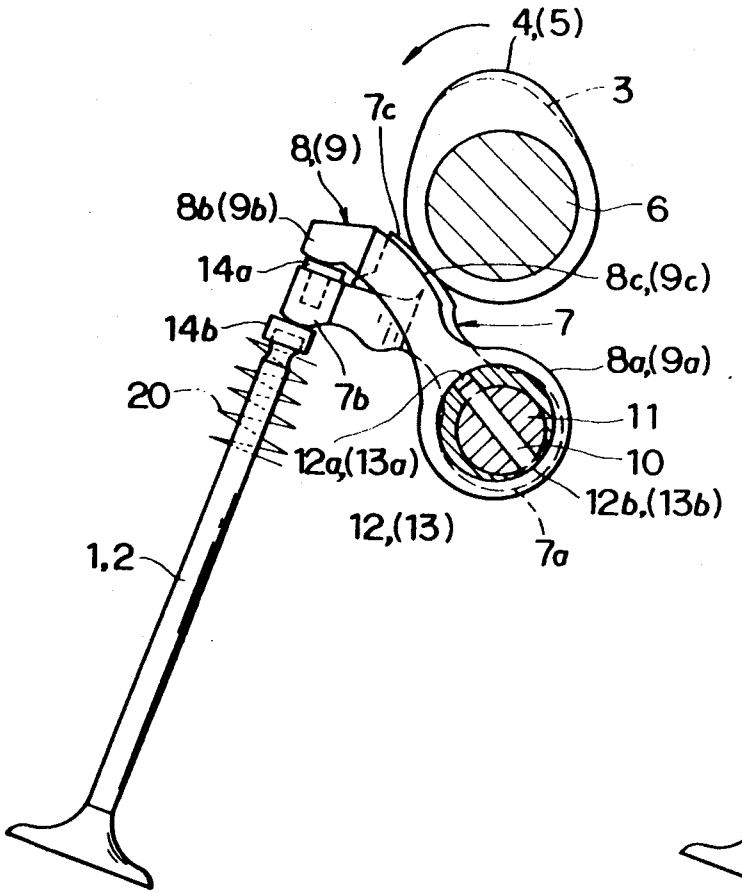
Figure 5:
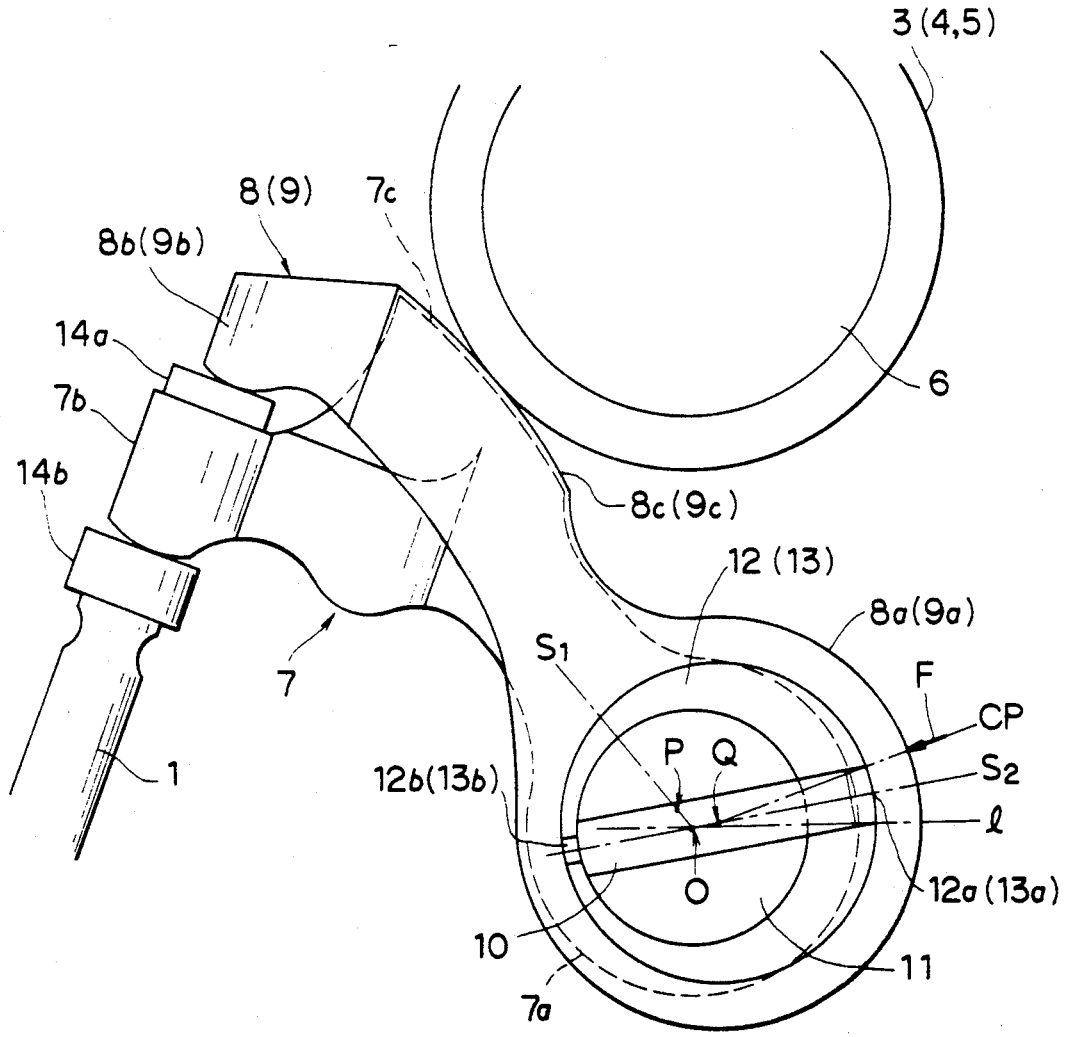
FIG. 5 is a side view showing the valve actuating mechanism shown in FIG. 4 in an enlarged manner.

A supporting portion 8*a* of the intermediate-high speed rocker arm 8 is mounted in a rotatable manner with respect to the rocker shaft 11 by means of an eccentric bushing 12 which has a diameter larger than that of the rocker shaft 11. As shown in FIG. 3 and FIG. 5, the eccentric bushing 12 has axial positions P, Q which are eccentric from the center 0 of the rocker shaft 11 and fixed to the rocker shaft 11 in a dismountable and reattachable manner by means of a stopper pin 10. Therefore, this eccentric bushing 12 serves as the eccentric large-diameter portion of the rocker shaft 11.

Figure 1:
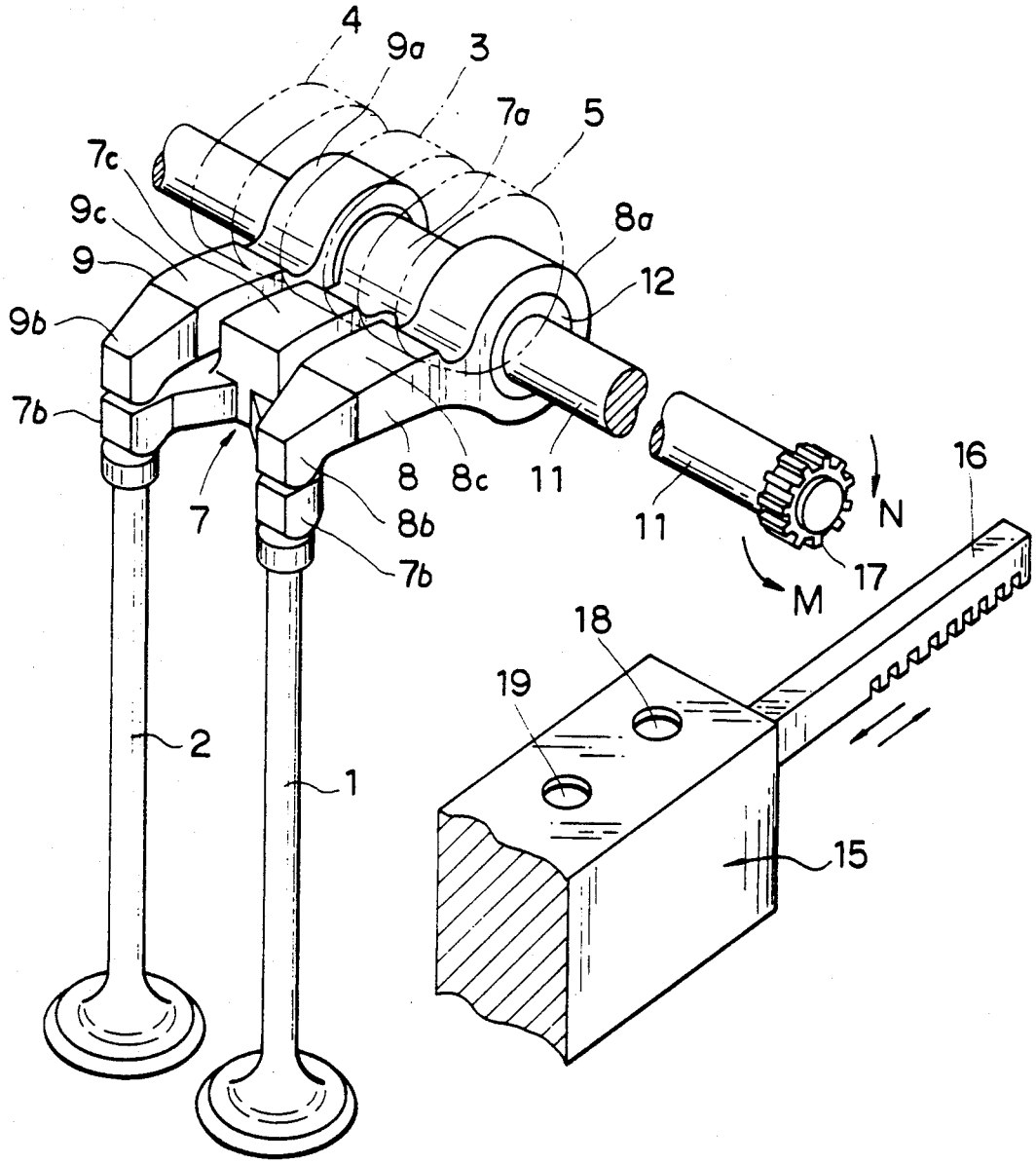
FIG. 1 is a perspective view showing a first embodiment of a valve actuating mechanism within a four-stroke cycle engine constructed according to the present invention.

As shown in FIG. 1, the supporting portion 9*a* of the intermediate-high speed rocker shaft 9 is also mounted in a rotatable manner with respect to the rocker shaft 11 by means of an eccentric bushing 13 which has an identical configuration and is eccentric in the same manner as the above described eccentric bushing 12. This eccentric bushing 13 is also fixed to the rocker shaft 11 in a dismountable and reattachable manner by means of a stopper pin 10 and serves as another eccentric large-diameter portion of the rocker shaft 11.

Figure 4:
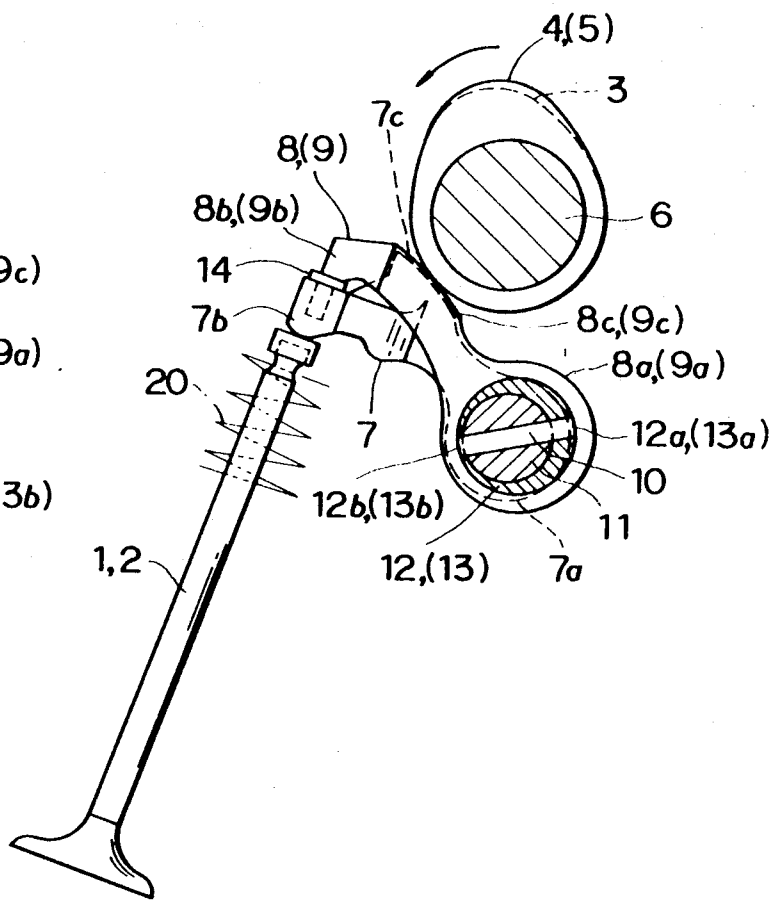
FIGS. 3 and 4 are views each being explanatory of a different state of operation of the valve actuating mechanism as shown in FIG. 1.

The axial position P of the eccentric bushings 12 and 13 designates the position of the axis for the low speed region of the engine where thick walled portions 12*a* and 13*a* are located diagonally inwardly (FIG. 3), and the axial position Q designates the position of the axis for the intermediate-high speed region of the engine where the thick walled portions 12*a* and 13*a* of the bushings are located diagonally outwardly (FIG. 4, FIG. 5).

Furthermore, the lower surfaces of distal end portions 8*b* and 9*b* of the intermediate-high speed rocker arms 8 and 9 are caused to abut against the branched distal end portions 7*b*, respectively of the rocker arm 7, by means of a shim 14*a* as best seen in FIG. 3. The points of contact defined between the branched portions 7*b* of the low speed rocker arm 7 and the distal end portions 8*b* and 9*b* of the intermediate-high speed rocker arms 8 and 9 are disposed upon the approximate axes of the valves 1 and 2, respectively.

Accordingly, as shown in FIG. 3, when the cam follower surface of the low speed rocker arm 7 is pushed downwardly by means of the low speed cam 3 so as to lower the distal end portions 7*b* of the rocker arm 7, the distal end portions 8*b* and 9*b* of the rocker arms 8 and 9 are caused to descend by means of gravity as a result of following branched portions 7*b*. On the other hand, as shown in FIG. 4 and FIG. 5, when the cam follower surfaces 8c and 9c of the intermediate-high speed rocker arms 8 and 9 are pushed downwardly by means of the intermediate-high speed cams 4 and 5, respectively, the distal end portions 8*b* and 9*b* of the rocker arms 8 and 9 push downwardly upon the distal end portions 7*b* of the low speed rocker arm 7 so that the distal end portions 7*b* are forced to descend.

The above described shim 14*a* is one having a T-shaped longitudinal section and is inserted within the top portions of both the branched end portions 7*b* of the low speed rocker arm 7. The valve stem heads of the valve 1 and 2 are each covered by means of a cylindrical shim 14*b* having a lid, and the lower surfaces of the branched distal end portions 7*b* of the low speed rocker arm 7 abut against the shims 14*b*. These shims 14*a* and 14*b* are used in adjusting the tappet clearance of a valve.

Furthermore, the intermediate-high speed cams 4 and 5 have the same cam profile with respect to each other, while the low speed cam 3 has a cam profile that is different from the cam profile of the intermediate-high speed cams 4 and 5. In other words, for the low speed cam 3, a cam profile is provided so as to obtain valve lift and timing of the opening or closing of the valves which are suitable when the engine is operated within the low speed region. Furthermore, for the intermediate-high speed cams 4 and 5, a cam profile is provided so as to obtain valve lift and timing of the opening-closing of the valves which are suitable when the engine is operated within the intermediate-high speed region.

Figure 8:
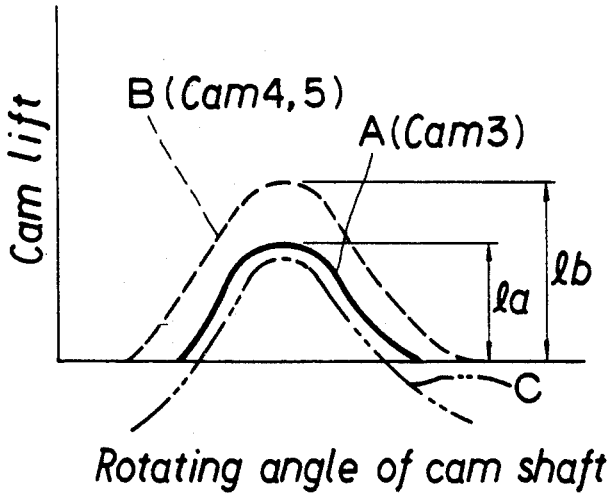
FIG. 8 is a graph showing the cam profile of a cam shown in FIG. 1 or FIG. 16, mentioned hereinafter.

The valve lifts as described above are the stroke length of the valves 1 and 2 and coincide with the cam lifts. In FIG. 8, the cam profile of the low speed cam 3 is indicated by means of the solid line A (cam lift 1*a*) while the cam profile of the intermediate-high speed cams 4 and 5 is indicated by means of the dashed line B (cam lift 1*b*). As can be seen from FIG. 8, the cam profile of the intermediate-high speed cams 4 and 5 is provided so as to obtain a valve lift which is larger than that of the low speed cam.

The two-dot chain line C as shown in FIG. 8 indicates the cam profile of the intermediate-high speed cams 4 and 5 when the rocker shaft 11 is rotated so as to place the thick walled portions 12*a* and 13*a* of the eccentric bushings 12 and 13 at the diagonally inward position (FIG. 3).

Figure 6:
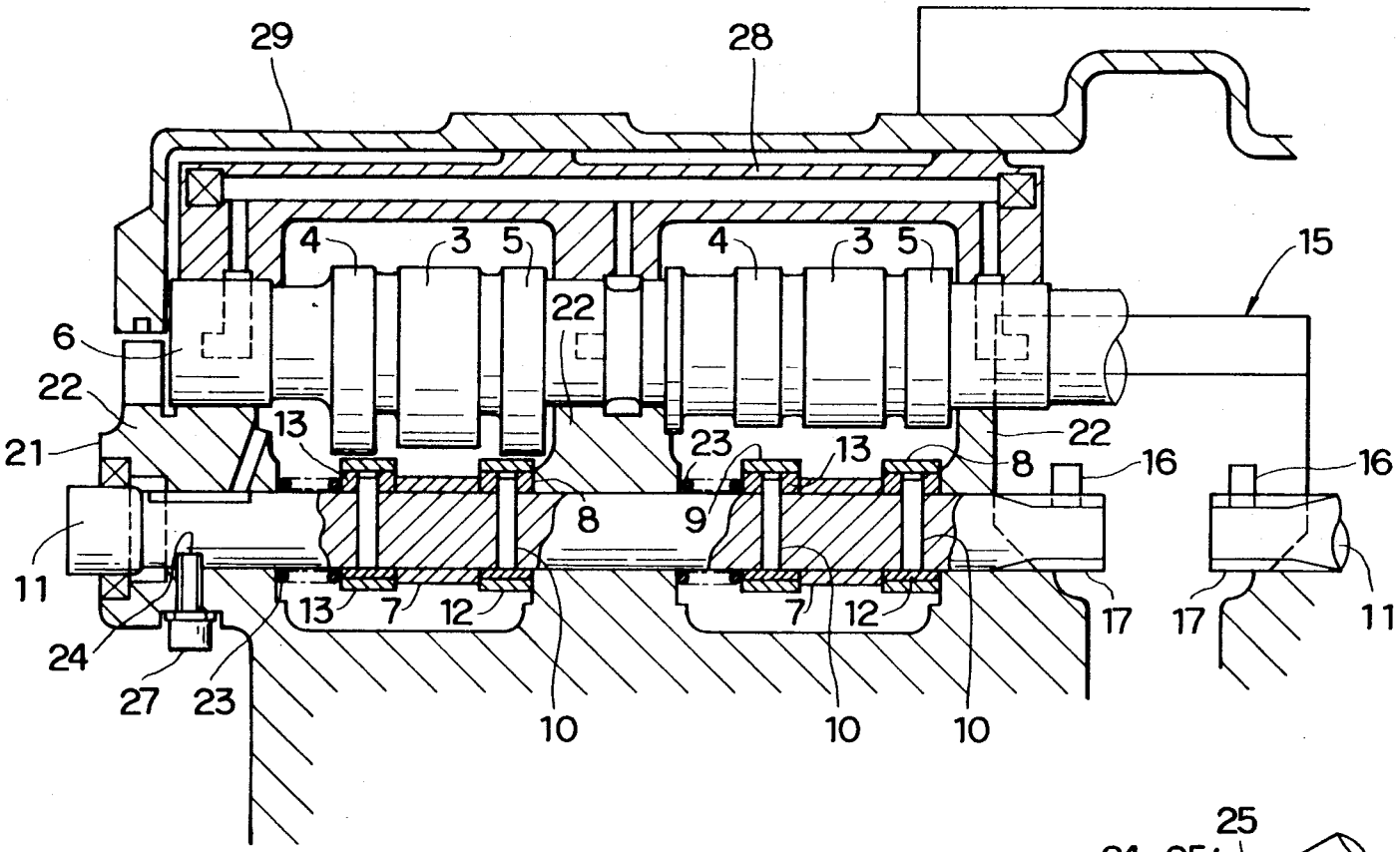
FIG. 6 is a longitudinal section of a cylinder head and other components to which the valve actuating mechanism of FIG. 1 is applied.

As shown in FIG. 1 and FIG. 6, the rotation of the rocker shaft 11 is caused by means of a hydraulic cylinder 15 which is actuated by means of the oil pressure from the engine. A piston, not shown, of this hydraulic cylinder 15 is coupled to a rack 16, and the rack 16 is meshed with a pinion 17 which is formed upon one end portion of the rocker shaft 11. A driving mechanism is therefore constituted by means of these hydraulic cylinder 15, rack 16 and pinion 17 elements. Also, a low-speed oil pressure port 18 and a high-speed oil pressure port 19 are provided upon the hydraulic cylinder 15, respectively, and the oil pressure from the engine is selectively introduced into each of the ports 18 and 19.

When the speed of the engine is within the low speed region, the oil pressure is supplied to the low-speed oil pressure port 18, pulling back the rack 16 so as to cause the pinion 17 to rotate in the direction of the arrow M (FIG. 1) so that as shown in FIG. 3 the eccentric bushings 12 and 13 are rotated so as to place their thick walled portions 12*a* and 13*a* at the diagonally inward positions. The axial center of the eccentric bushings 12 and 13 at this time is therefore at the axial position P (FIG. 5). Conversely, when the engine speed is within the intermediate-high speed region, the oil pressure is supplied to the intermediate-high speed oil pressure port 19, thereby extending the rack 16 so as to cause the pinion 17 to rotate in the direction of the arrow N (FIG. 4) so that as shown in FIG. 4 and FIG. 5 the eccentric bushings 12 and 13 are rotated so as to place their thick walled portions 12*a* and 13*a* at the diagonally outward positions. The axial center of the eccentric bushings 12 and 13 at this time is disposed at the axial position Q.

In this way, the rocker shaft 11 is constructed such that he axis of the eccentric bushings 12 and 13 is moved by means of the action of the hydraulic cylinder 15, the rack 16 and the pinion 17 and is at all times disposed within the upper half of the rocker shaft 11, that is, within the range from the axial position P to the axial position Q and at a position disposed above the reference line l of the rocker shaft. Here the reference line l is the horizontal line passing through the center 0 of the rocker shaft 11. Furthermore, in the description that follows, the axial position P will be referred to as the diagonally outward movable limit of the axis of the eccentric bushings 12 and 13.

The rocker shaft 11, the hydraulic cylinder 15 and the other components as described above are arranged within a cylinder head 21 as shown in FIG. 6. A total of four rocker shafts 11 are arranged within the cylinder head 21, each placed toward front and rear and left and right positions of the vehicle and are extended in a left and right direction with respect to the vehicle. Each of the rocker shafts 11 is supported in a rotatable manner by means of a rocker shaft bearing portion 22. The cam shaft 6 is arranged at a position above these rocker shafts 11. Furthermore, two sets of the low speed rocker arms 7 and the intermediate-high speed rocker arms 8 and 9 are mounted upon a single rocker shaft 11. Each set of the low speed rocker arm 7 and the intermediate-high speed rocker arms 8 and 9 is axially restricted in position together with the rocker shaft 11 by means of a positioning spring 23 placed upon the rocker shaft 11.

Figure 7:
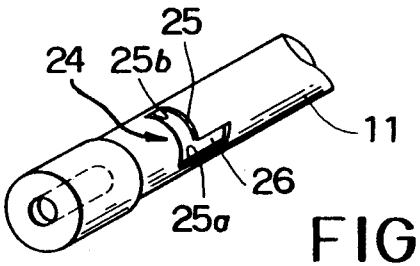
FIG. 7 is a perspective view showing the other end portion of the rocker shaft as shown in FIG. 6.

Also, as shown in FIG. 6 and FIG. 7, the rocker shaft 11 upon which the pinion 17 is formed at one end portion thereof is provided with a stopper groove 24 upon the peripheral surface of the other end portion thereof. This stopper groove 24 is extended in the circumferential direction of the rocker shaft 11 and comprises a stopper portion 25 which is formed over the range of the rotating angle of the rocker shaft 11 and a slide portion 26 which is extended in the axial direction of the rocker arm 11 from one or both of the two ends of the stopper portion 25. In FIG. 7, a case is shown where the slide portion 26 is extended from one end of the stopper portion 25.

On the other hand, a stopper screw 27 is attached to the cylinder head 21 by means of threaded engagement at a position corresponding to the stopper portion 25 of the above described stopper groove 24. The distal end of the stopper screw 27 is caused to abut against the two ends 25*a* and 25*b* of the stopper portion 25 when the rocker shaft 11 is rotated by means of the action of the hydraulic cylinder 15. Accordingly, the rotation of the rocker shaft 11 is restricted and the rocker shaft 11 is caused to stop rotatably at the limits defined by means of the ends 25*a* and 25*b* of the stopper portion 25.

When the stopper screw 27 abuts against the end 25*a* of the stopper portion 25, thick walled portions 12*a* and 13*a* of the eccentric bushings 12 and 13 are disposed at the diagonally inward stopping positions $S_1$, and the axes of the eccentric bushings 12 and 13 at this time are positioned at the diagonally inward movable limit axial position P. Furthermore, when the stopper screw 27 abuts against the other end 25*b* of the stopper portion 25, the thick walled portions 12*a* and 13*a* of the eccentr1c bushings 12 and 13 are disposed at the diagonally outward stopping positions $S_2$, and the axes of the eccentric bushings 12 and 13 at this time are positioned at the diagonally outward movable limit axial position Q.

The diagonally inward stopping position $S_1$ of the eccentric bushings 12 and 13 is indicated by means of a straight line connecting the center 0 of the rocker shaft 11 and the diagonally inward movable limit axial position P of the axes of the eccentric bushings 12 and 13, while the diagonally outward stopping position $S_2$ of the eccentric bushings 12 and 13 is indicated by means of a straight line connecting the center 0 of the rocker shaft 11 and the diagonally outward movable limit axial position Q of the axes of the eccentric bushings 12 and 13.

Figure 11A:
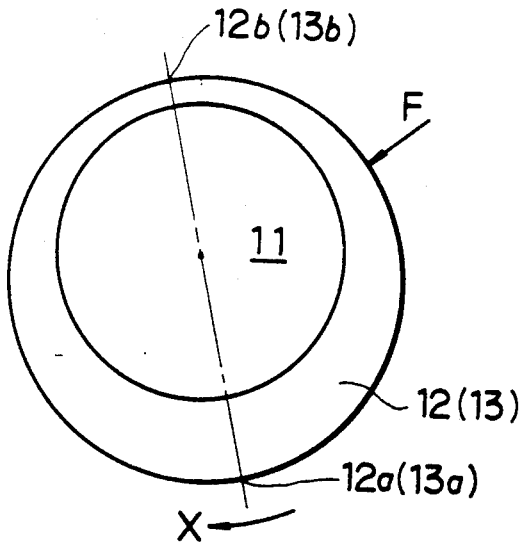
FIGS. 11A to 11C are views illustrating the stable rotation of the eccentric bushing when a force is applied thereto.
Figure 11B:
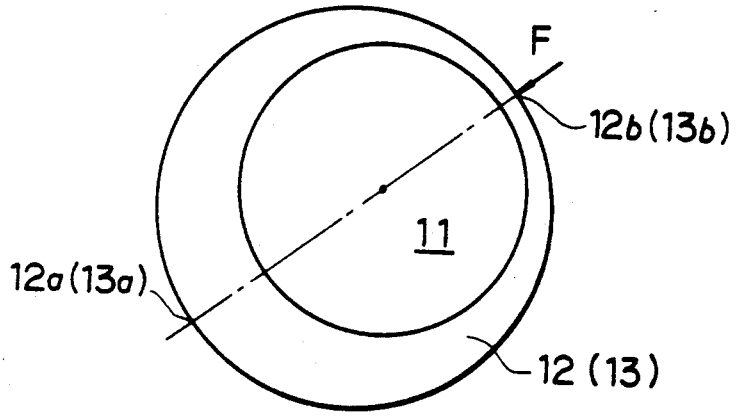

In this configuration, when the intermediate-high speed rocker arms 8 and 9 are driven by means of the intermediate-high speed cams 4 and 5 during the intermediate-high speed region of the engine, a force F is exerted from the intermediate-high speed rocker arms 8 and 9 toward the rocker shaft 11 by means of the eccentric bushings 12 and 13. When such force F acts upon the bushing assemblies, as shown in FIGS. 11A and 11B, the eccentric bushings 12 and 13 exhibit an operational characteristic such that they tend to rotate in the direction of arrow X so to as bring thin walled portions 12*b* (13*b*) of the eccentric bushings 12 and 13 toward the point of application of the force F so as to stabilize the rocker arm assemblies.

Figure 11C:
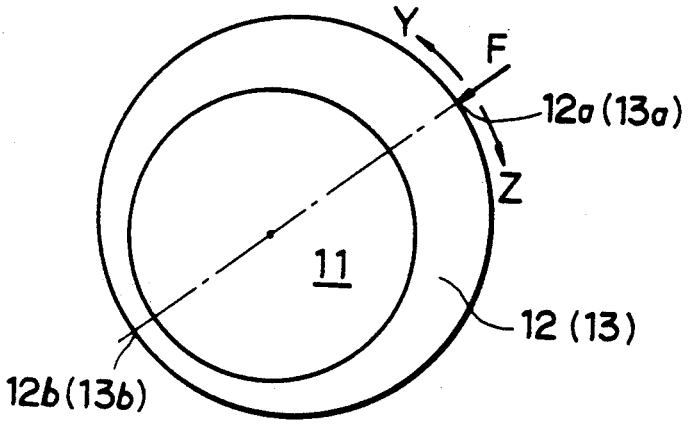

Also, as shown in FIG. 11C, since the eccentric bushings 12 and 13 tend to be rotated in either one of the directions Y and Z when the force F acts upon the thick walled portions 12*a* and 13*a* of the eccentric bushings 12 and 13, such position is referred to as dead point CP upon the arrival of the thick walled portions 12*a* and 13*a* at such position at which force F is applied.

In a process during which the engine is shifted from its low speed region to its intermediate-high speed region and as shown in FIG. 5 the thick walled portions 12*a* and 13*a* of the eccentric bushings 12 and 13 are moved from the diagonally inward stopping position $S_1$ to the diagonally outward stopping position $S_2$ (the axes of the bushings are moved from the diagonally inward movable limit axial position P to the diagonally outward movable limit Q axial position), a gradually increasing rotating force is required until the thick walled portions 12*a* and 13*a* reach the dead point CP because the rocker shaft 11 is being rotated in the direction opposite to the direction toward which the eccentric bushings 12 and 13 tend to be stabilized. On the other hand, when the eccentric bushings 12*a* and 13*a* have been moved beyond the dead point CP, since the rocker shaft 11 is rotated in the same direction as that toward which the eccentric bushings 12 and 13 tend to be stabilized, the rocker shaft 11 may be rotated by means of a minimal rotating force and thus the thick walled portions 12*a* and 13*a* may be set to the diagonally outward stopping position $S_2$.

The slide portion 26 of the above described stopper groove 24 serves its function when the shim 14*b* mounted upon one of the stem heads of the valves 1, 2 is replaced so as to adjust the tappet clearance. In other words, while it is necessary in replacing the shim 14*b* to slide the rocker shaft 11 outwardly with respect to the cylinder head 21 against the biasing force of the positioning spring 23 so as to move the low speed rocker arm 7 and the intermediate-high speed rocker arms 8 and 9 in the same direction, the distal end of the stopper screw 27 is moved within the slide portion 26 during such process. Furthermore, numeral 28 in FIG. 6 denotes a bearing housing for the cam shaft 6, and numeral 29 denotes a cam shaft housing.

The operation and effects of this invention will now be described hereunder.

If the rocker shaft 11 is rotated in the direction of the arrow M as shown in FIG. 1 by means of the action of the hydraulic cylinder 15 when the engine is being operated within the low speed region, the thick walled portions 12*a* and 13*a* respectively of the eccentric bushings 12 and 13 are positioned diagonally inward (FIG. 3). Thus the cam follower surfaces 8*c* and 9*c* of the intermediate-high speed rocker arms 8 and 9 are moved relatively downwardly with respect to the cam follower surface 7*c* of the low speed rocker arm 7. Accordingly, a gap is formed between the peripheral surfaces of the intermediate-high speed cams, 4, 5 and the cam follower surfaces 8*c*, 9*c* of the intermediate-high speed rocker arms 8 and 9, and as a result, the intermediate-high speed cams 4 and 5 operate or rotate in an idle mode.

Furthermore, since the low speed rocker arm 7 at this time is continuously pushed upwardly about the axial center of the rocker shaft 11 by means of the biasing force of a valve spring 20, its cam follower surface 7*c* is brought into contact with the peripheral surface of the low speed cam 3. Therefore, when the cam shaft 6 is rotated, the intake and exhaust valves 1 and 2 are moved in an up and down direction or mode in accordance with the lift characteristic A of the low speed cam 3 as shown in FIG. 8. In other words, the valves 1 and 2 open and close the combustion chamber while imparting a lift to the valve which is suitable for the low speed region operation of the engine.

On the other hand, if the rocker shaft 11 is rotated in the direction of the arrow N as shown in FIG. 1 by means of the action of the hydraulic cylinder 15 when the engine is being operated within the intermediate-high speed region, the thick walled portions 12*a* and 13*a* respectively of the eccentric bushings 12 and 13 are brought to the diagonally outward position (FIG. 4 and FIG. 5). Thus the cam follower surfaces 8*c* and 9*c* of the intermediate-high speed rocker arms 8 and 9 are moved in relation to the cam follower surface 7*c* of the low speed rocker arm 7 to a position generally above that or at the same level as that of the cam follower surface 7*c*, bringing the cam follower surfaces 8*c* and 9*c* into contact with the peripheral surfaces of the medium-high speed cams 4 and 5, respectively.

Figure 9:
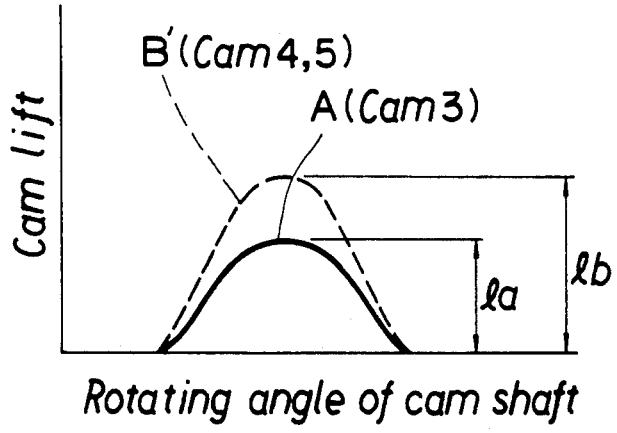
FIGS. 9 and 10 are graphs each showing an example of a modification of the cam profile as shown in FIG. 8.

Consequently, since as shown in FIG. 8 the intermediate-high speed cams 4 and 5 are formed so as to have a cam lift which is larger than that of the low speed cam 3, the low speed cam 3 rotates or operates in an idle mode when the cam shaft 6 is rotated under the condition as shown in FIG. 4 and FIG. 5 while the intermediate-high speed cams 4 and 5 drive the valves 1 and 2 in accordance with the lift characteristic B in FIG. 9 by means of the intermediate-high speed rocker arms 8 and 9, respectively. As a result, the valves 1 and 2 open or close the combustion chamber while undergoing a valve lift which is suitable for the intermediate-high speed region operation of the engine.

According to the above described embodiment, a cam profile suitable for the low speed region operation of the engine is formed upon the low speed cam 3, a cam profile suitable for the intermediate-high speed region operation of the engine is formed upon the intermediate-high speed cams 4 and 5, the intermediate-high speed rocker arms 8 and 9 are mounted in a rotatable manner respectively onto the eccentric bushings 12 and 13 of the rocker shaft 11, the low speed rocker arm 7 is mounted directly upon the rocker shaft 11, it is possible by means of the rotation of the rocker shaft 11 to alternatively select a contact mode defined between the low speed cam 3 and the low speed rocker arm 7 and another mode occurring respectively between the intermediate-high speed cams 4 and 5 and the intermediate-high speed rocker arms 8 and 9, and the valves 1 and 2 may thus be selectively driven by means of the low speed cam 3 or by means of the intermediate-high speed cams 4 and 5. Therefore, it is possible to improve the output of a four-stroke cycle engine for a wide range of operation extending from the low speed region to the intermediate-high speed region of operation of the engine.

Also, since the selection between the low speed cam 3 and the intermediate-high speed cams 4 and 5 is performed by means of the rotation of the eccentric bushings 12 and 13, a large stress does not occur at each of these portions when a selection is to be made between the cams 3, 4 and 5. Thus cams 3, 4 and 5 may be smoothly selected.

Furthermore, the axis of the eccentric bushings 12 and 13 is moved within the upper half side or region of the rocker shaft 11 within the range extending from the diagonally inward movable limit position P to the diagonally outward movable limit position Q so that a changeover may be selectively made between a drive by means of the low speed rocker arm 7 in accordance with the operational characteristics of the low speed cam 3 and a drive by means of the intermediate-high speed rocker arms 8 and 9 in accordance with the operational characteristics of the intermediate-high speed cams 4 and 5. In addition, when the thick walled portions 12*a* and 13*a* of the eccentric bushings 12 and 13 are disposed at the diagonally outward stopping position $S_2$ (that is, the axes of the eccentric bushings 12 and 13 are disposed at the diagonally outward movable limit position Q) so as to drive the intermediate-high speed rocker arms 8 and 9, since such position is disposed at a position beyond the dead point CP, the rotating direction of the rocker shaft 11 and the direction toward which the eccentric bushings 12 and 13 tend to be stabilized coincide with each other when the thick walled portions 12*a* and 13*a* are moved from the dead point CP to the diagonally outward stopping position $S_2$. As a result, the holding force for retaining the eccentric bushings 12 and 13 at such diagonally outward stopping position $S_2$ may be very small.

Accordingly, during the intermediate-high speed region operation of the engine where the thick walled portions 12*a* and 13*a* of the eccentric bushings 12 and 13 are disposed at the diagonally outward stopping position $S_2$ so as to drive the intermediate-high speed rocker arms 8 and 9, the eccentric bushings 12 and 13 and thus the rocker shaft 11 will not be swung or pivoted in a free or loose manner even if the intermediate-high speed rocker arms 8 and 9 are intensely swung in an up and down direction or mode, and as a result abrasion of the rocker shaft 11 and its bearing portion 22 may be prevented.

Furthermore, since, in the intermediate-high speed region operation of the engine, the holding force for retaining the rocker shaft 11 at the predetermined position ($S_2$) may be made smaller, the capacity of the hydraulic cylinder 15 to produce such holding force may be reduced. Thus the hydraulic cylinder 15 may be made smaller in size, whereby the degree of freedom with respect to the positioning of the hydraulic cylinder 15 may be improved and the costs thereof may also be reduced.

In addition, in a case where the shim 14*b* disposed between each branched distal end portion 7*b* of the low speed rocker arm 7 and where the shims 14 are interposed between the branched distal end portions 7*b* of the low-speed rocker arm 7 and the distal end portion 8*b* (9*b*) of the intermediate-high speed rocker arm 8 (9) is to be adjusted, these rocker arms 7, and 9 are slid in the axial direction of the rocker shaft 11, and accordingly, even in a case where the supporting portions 8*a* and 9*a* of the intermediate-high speed rocker arms 8 and 9 are disengaged from the eccentric bushings 12 and 13, the rocker shaft 11 is rotated in the state in which the thick walled portions 12*a* and 13*a* of the eccentric bushings 12 and 13 are always positioned within the upper half side of the rocker shaft 11, so that the stopper pin 10 fixedly mounting the eccentric bushings 12 and 13 upon the rocker shaft 11 cannot fall out or be inadvertently disengaged therefrom.

Figure 12A:
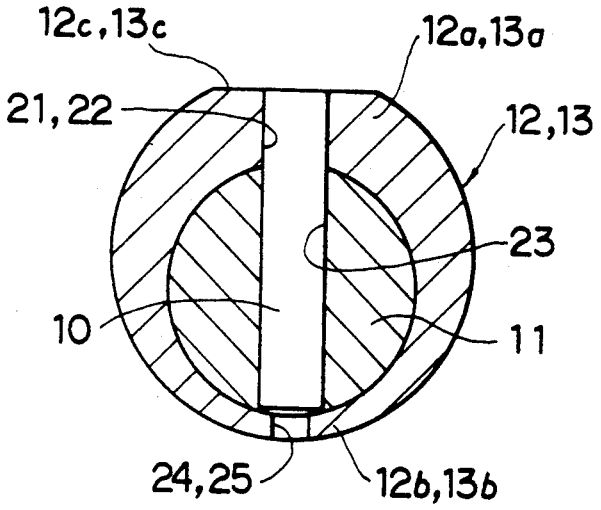
FIG. 12A is a sectional view showing the eccentric bushing and the rocker shaft of the mechanism shown in FIG. 1.
Figure 12B:
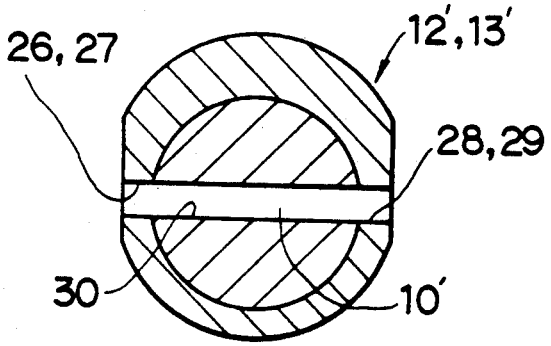
FIG. 12B is a view similar to that of FIG. 12A, in which a comparative eccentric bushing is shown.

Furthermore, referring to FIGS. 12A and 12B, the eccentric bushings 12 and 13 are provided with the pin insertion holes 21 and 22 at the thick walled top portions 12*a* and 13*a*, and the pin draw-out holes 24 and 25, having diameters smaller than those of the pin insertion holes 21 and 22, at the thin walled portions 12*b* and 13*b*. Moreover, flat portions 13 are formed upon the thick walled top portions 12*a* and 13*a* so as to be coaxial with the pin insertion holes 21 and 22 which require high performance, whereas no flat portion is formed upon each of the thin walled portions 12*b* and 13*b*. According to this structure, the wall thickness of the eccentric bushings 12 and 13 are uncompromised, thus improving the entire strength of the eccentric bushings 12 and 13.

As shown in FIG. 12B, when a stopper pin 10' is inserted horizontally, as viewed, with respect to eccentric bushings 12' and 13', respectively two pin insertion holes 26, 27 and 28, 29 for the eccentric bushings 12' and 13' must be formed coaxially, and in addition, for these insertion holes 26, 27 and 28, 29, there is thus required severe tolerances or small differences of a minor degree characteristic of the coaxial state with respect to the pin insertion hole 30 of the rocker shaft 11.

On the other hand, with respect to the eccentric bushings 12 and 13 shown in FIG. 12A, the eccentric bushings 12 and 13 are each provided with only one pin insertion hole 21 or 22, and accordingly the severe tolerances as described above are required only for the pin insertion holes 21 and 22 and the pin insertion holes 23 of the rocker shaft 11 and not for the pin draw-out holes 24 and 25, for which only general tolerance will be required. For this reason, the manufacturing costs for the eccentric bushings 12 and 13 and the rocker shaft 11 can be significantly reduced.

Figure 10:
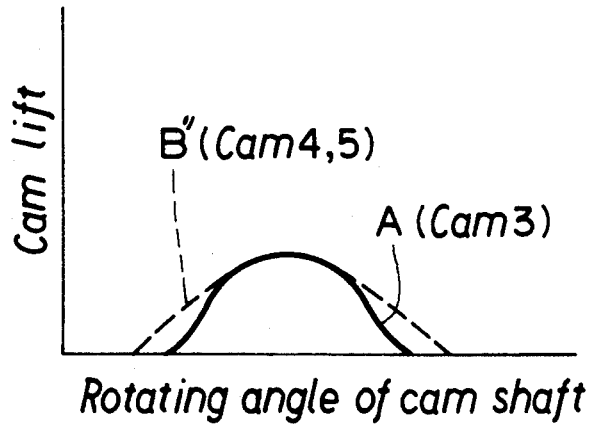

While, the above embodiment has been described with respect to a case where the cam profile of the intermediate-high speed cams 4 and 5 is one as indicated by means of the broken line B in FIG. 8, the cam profile of the intermediate-high speed cams 4 and 5 may be adapted to be one as indicated by means of the broken line B' in FIG. 9 or by means of the broken line B'' in FIG. 10 so as to change the lift characteristics of the valves 1 and 2 during the intermediate-high speed operation of the engine.

Also, while the description of the above embodiment has been given with respect to the case where the hydraulic cylinder 15 is used as the driving source for the rotation of the rocker shaft 11, a motor may be used as the driving source of rotation where the rocker shaft 11 is driven so as to be rotated by using power transmission means such as, for example, a pulley and belt.

As has been described, with a valve actuating mechanism within a four-stroke cycle engine constructed according to this invention, eccentric large-diameter portions are formed upon a rocker shaft which is supported in a rotatable manner, second and third rocker arms are mounted upon the eccentric large-diameter portions, and a first rocker arm is located between the second and third rocker arms and is mounted directly upon the rocker shaft. It is thus possible to improve the output of the engine for a wide speed range by selecting the cams as described above through means of the selective rotation of the rocker shaft.

Furthermore, the rocker shaft is rotated so that the axis of each one of the eccentric large-diameter portions is moved within the upper half side of the rocker shaft, and a movable limit of the axes, that is, its diagonally outward movable limit at which the second and third cams are caused to drive the second and third rocker arms is located at a position beyond a dead point of the eccentric large-diameter portions. Thus, when the axes of the eccentric large-diameter portions are moved beyond such dead point, the rotating direction of the rocker shaft and the direction toward which the eccentric large-diameter portions are stabilized coincide with each other whereby the force for rotating the rocker shaft may be rendered very small. As a result the necessary holding force for retaining the axes of the eccentric large-diameter portions at the diagonally outward movable limit may also be reduced.

A second embodiment of the valve actuating mechanism constructed according to the present invention will now be described hereunder with reference to FIGS. 13 to 17, in which like reference numerals are added to members or elements corresponding to those of the first embodiment shown in FIGS. 1 to 12 and the description thereof is therefore omitted herefrom.

Figure 13:
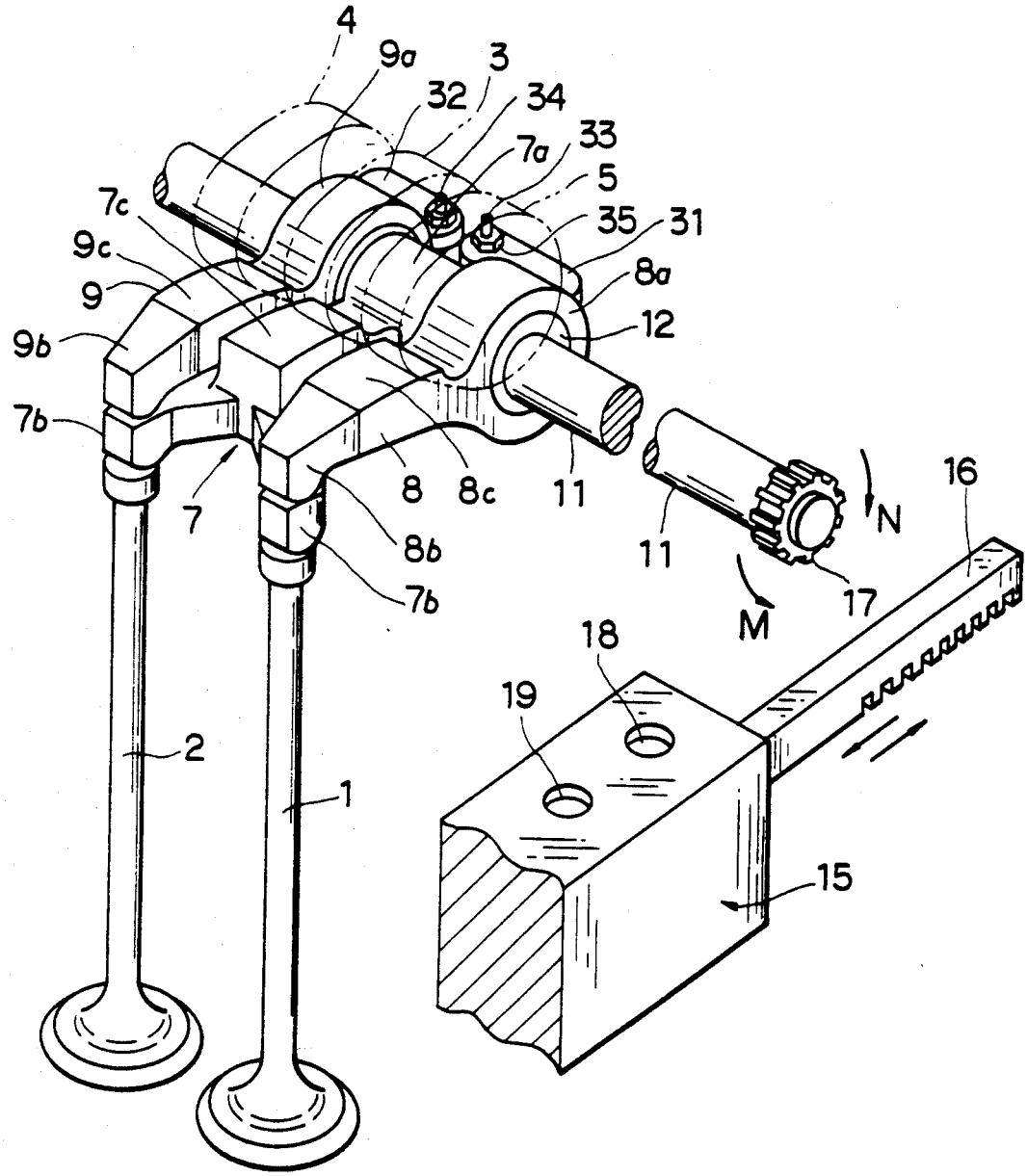
FIG. 13 is a perspective view showing a second embodiment of a valve actuating mechanism disposed within a four-stroke cycle engine constructed according to the present invention.
Figure 15:
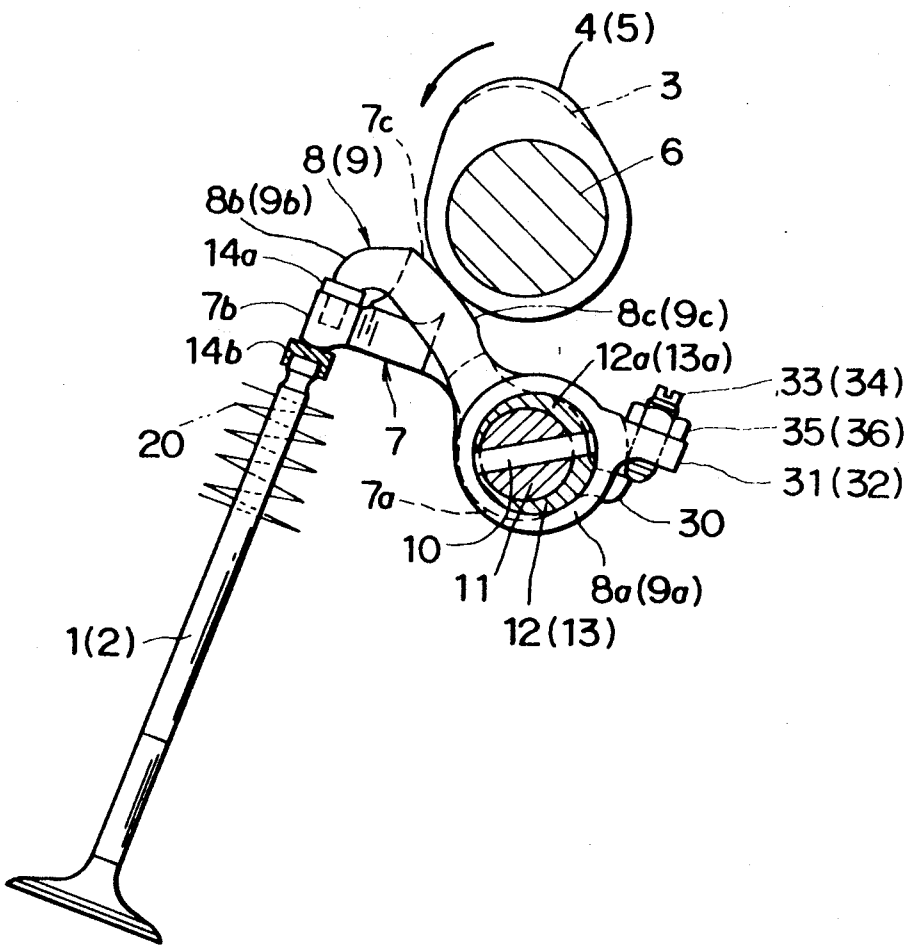
FIGS. 14 and 15 are views each of which is explanatory of a state of operation of the valve actuating mechanism as shown in FIG. 13.
Figure 16:
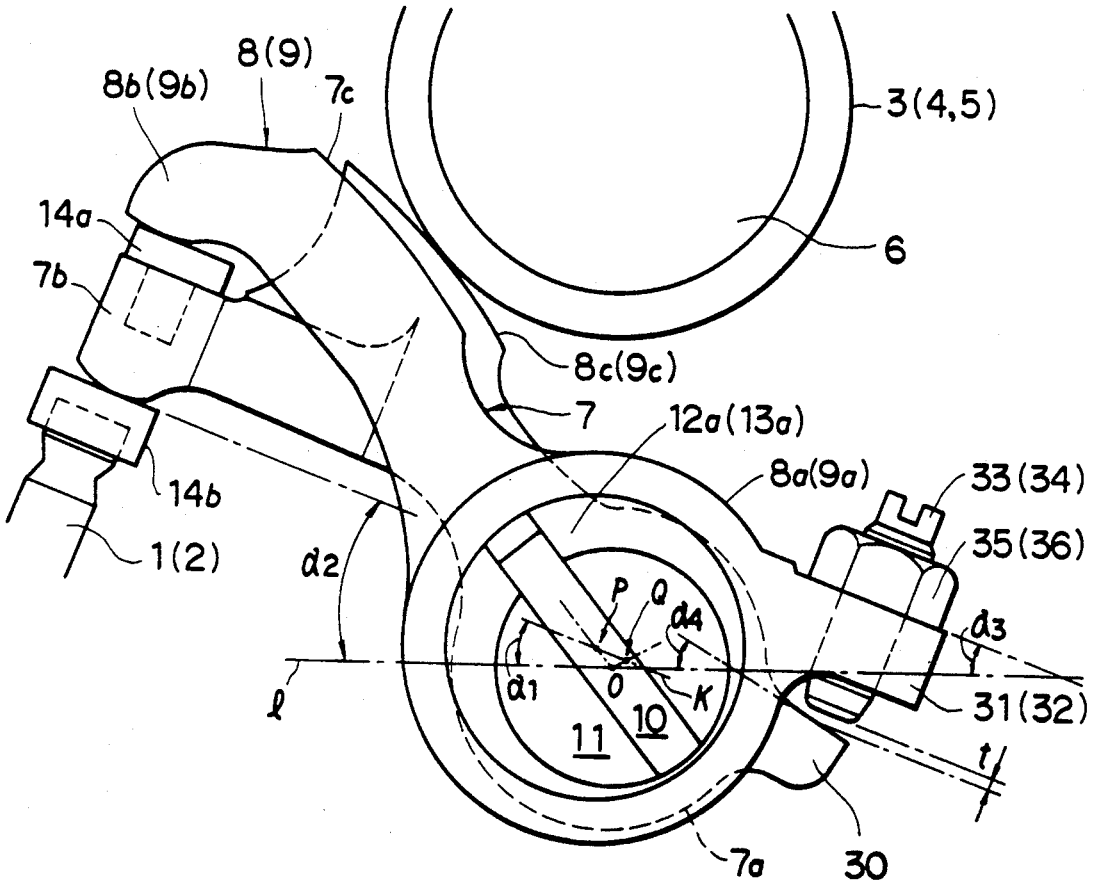
FIG. 16 is a side view showing the valve actuating mechanism shown on FIG. 15 in an enlarged scale.
Figure 17:
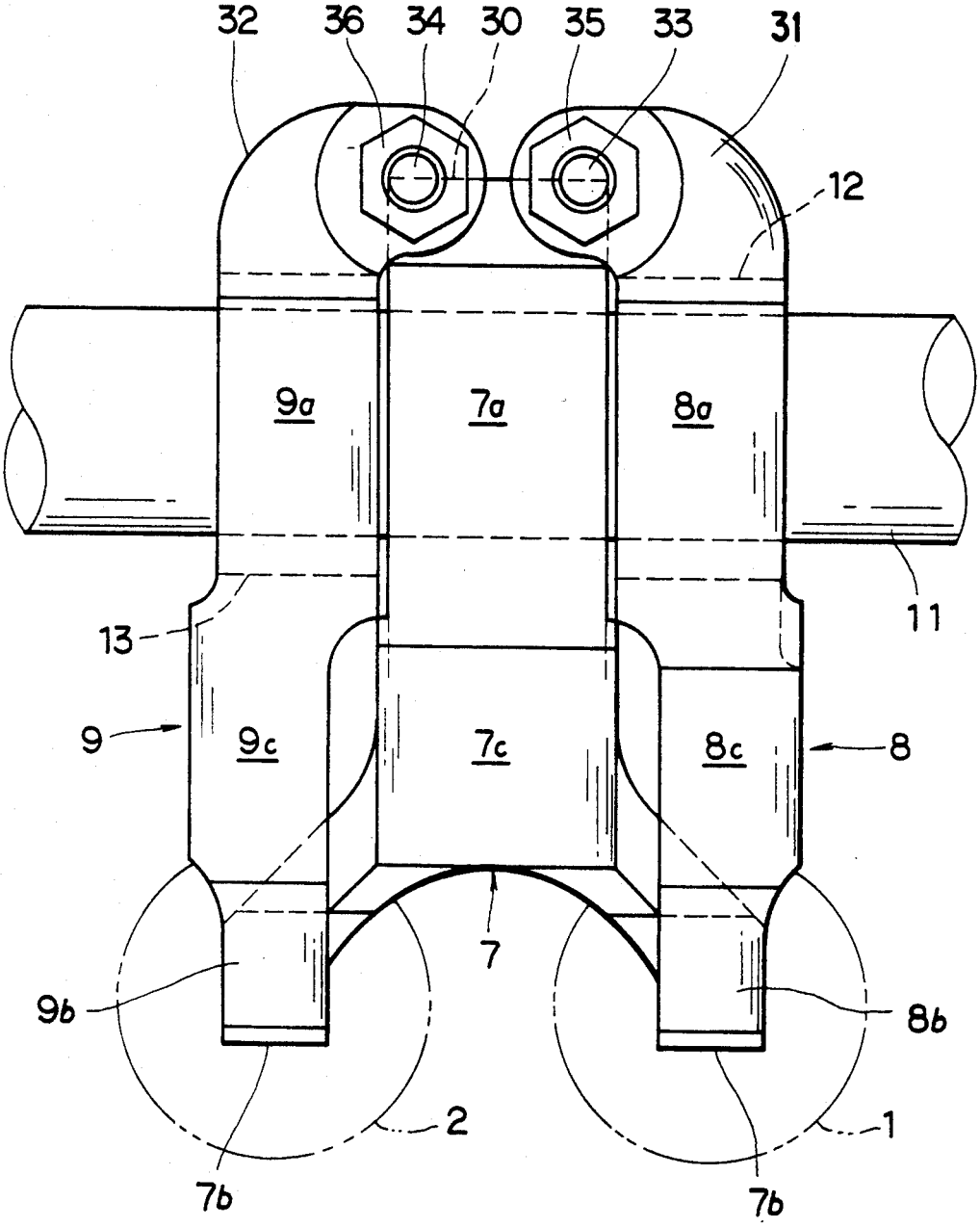
FIG. 17 is a plan view showing the valve actuating mechanism of this second embodiment.

Referring to FIGS. 13 to 17, particularly to FIG. 13 and FIG. 16, the supporting portion *7a* of the low-speed rocker arm 7 as described before is formed integrally with a screw receiving portion 30. Such screw receiving portion 30 is extended in the direction opposite to the branched distal end portion *7b* with respect to the supporting portion *7a* and has a width which is substantially the same as that of the supporting portion *7a*.

On the other hand, the supporting portions *8a* and *9a* of the intermediate-high speed rocker arms 8 and 9 are formed integrally with adjustment arms 31 and 32, respectively. These adjustment arms 31 and 32 are extended in the direction opposite to the distal end portions *8b* and *9b* with respect to the supporting portions *8a* and *9a* and are disposed toward the screw receiving portion 30 during their operations. Adjustment screws 33 and 34 are attached by means of threaded engagement means to the respective distal end portions of these adjustment arms 31 and 32, and lock nuts 35 and 36 are threaded onto these adjustment screws 33 and 34.

The clearance defined between the distal end portion of the adjustment screws 33, 34, and the screw receiving portion 30 is adjustable by loosening the lock nuts 35 and 36 and then by advancing or withdrawing the adjustment screws 33 and 34. During the low speed operation region of the engine, while the intermediate-high speed rocker arms 8 and 9 are not brought into contact with the intermediate-high speed cams 4 and 5, respectively, and are put into their floating or idle state, the upper surface of the screw receiving portion 30 of the low speed rocker arm 7 abuts against the distal end portions of the adjustment screws 33 and 34 so as to rotate the distal end portions *8b* and *9b* of the intermediate-high speed rocker arms 8 and 9 toward the branched distal end portions *7b* of the low-speed rocker arm 7 so that the intermediate-high speed rocker arms 8 and 9 are synchronized with the movement of the low speed rocker arm 7. In this way, the occurrence of striking noise is prevented between the intermediate-high speed rocker arms 8 and 9 and the intermediate-high speed cams 4 and 5.

The clearance defined between the above described adjustment screws 33 and 34 and the screw receiving portion 30 is substantially the same as the tappet clearance when the thick walled portions *12a* and *13a* of the eccentric bushings 12 and 13 are positioned diagonally forwardly (that is, for the low speed region of the engine), although it varies depending upon the tolerable amount of the striking noise.

Furthermore, with respect to the mounting position of the adjustment screws 33 and 34, the distance defined between the adjustment screws 33 and 34 and the rocker shaft 11, or the attachment angle of the adjustment arms 31 and 32 are designed such that a clearance which is equal to or greater than the clearance as described above, that is, which is approximately the same as the tappet clearance is defined when the thick walled portions *12a* and *13a* are positioned diagonally rearwardly (that is, for the low speed region of the engine) or when the thick walled portions *12a* and *13a* are changed from the diagonally forward position to the diagonally rearward position. For example, when the horizontal line passing through the center 0 of the rocker shaft 11 is defined as a reference line l and the straight line connecting the axial center positions P and Q of the eccentric bushings 12 and 13 is designated as k, they are designed to satisfy the relationships:

$$\alpha_1 \approx \alpha_2 \approx \alpha_3 \approx \alpha_4 - (5^\circ \sim 15^\circ)$$

wherein $\alpha_1$ is the angle defined between the reference line l and the straight line k, $\alpha_2$ is the angle defined between the upper surface of the shim *14b* and the reference line l (valve attaching angle), $\alpha_3$ is the angle defined between the upper surfaces of the adjustment arms 31 and 32 and the reference line l, and $\alpha_4$ is the angle defined between the upper surface of the screw receiving portion 30 and the reference line l. With such a design, when the thick walled portions *12a* and *13a* are positioned diagonally rearwardly or when they are changed from their diagonally forward to their diagonally rearward positions forward to their diagonally rearward positions, their state or their change is not impeded by means of the adjustment screws 33 and 34 nor by means of the screw receiving portion 30.

The operation of this embodiment will now be described.

Figure 14:
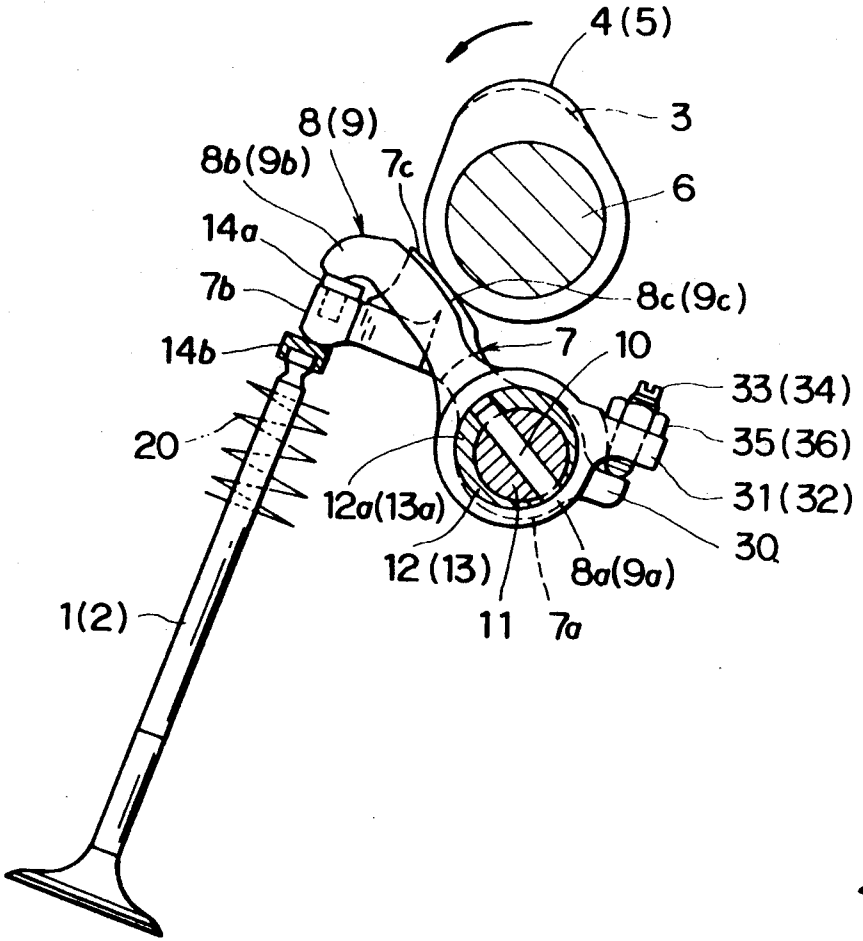

If the rocker shaft 11 is rotated in the direction of the arrow M (FIG. 13) by means of the action of the hydraulic cylinder 15 when the engine is being operated within the low speed region, the thick walled portions *12a* and *13a* respectively of the eccentric bushings 12 and 13 are positioned diagonally forwardly (FIG. 14). Thus the cam follower surfaces *8c* and *9c* of the intermediate-high speed rocker arms 8 and 9 are moved downwardly with respect to the cam follower surface *7c* of the low speed rocker arm 7. Accordingly, a gap is formed between the peripheral surfaces of the intermediate-high speed cams 4 and 5 and the cam follower surfaces *8c* and *9c* of the intermediate-high speed rocker arms 8 and 9, and as a result the intermediate-high speed cams 4 and 5 operate in an idle mode.

Furthermore, since the low speed rocker arm 7 at this time is continuously pushed upwardly about the axial center of the rocker shaft 11 by means of the biasing force of the valve spring 20, its cam follower surface *7c* is brought into contact with the peripheral surface of the low speed cam 3. Therefore, when the cam shaft 6 is rotated, the valves 1 and 2 are moved in an up and down direction based upon the lift characteristic A of the low speed cam 3 as shown in FIG. 9. In other words, the valves 1 and 2 open-close the combustion chamber while defining lift characteristics for the valves which are suitable for the low speed operation of the engine.

On the other hand, if the rocker shaft 11 is rotated in the direction of the arrow N (FIG. 13) by means of the action of the hydraulic cylinder 15 when the engine is being operated within the intermediate-high speed region, the thick walled portions *12a* and *13a* respectively of the eccentric bushings 12 and 13 are brought to the diagonally rearward position (FIG. 15). Thus the cam follower surfaces *8c* and *9c* of the intermediate-high speed rocker arms 8 and 9 are moved upwardly with respect to the cam follower surface *7c* of the low speed rocker arm 7 to a position generally above that or at the same level as that of the cam follower surface *7c*, bringing the cam follower surfaces *8c* and *9c* into contact with the peripheral surfaces of the intermediate-high speed cams 4 and 5, respectively.

Hence, since as shown in FIG. 8 the intermediate-high speed cams 4 and 5 are formed so as to have a cam lift characteristic which is larger than that of the low speed cam 3, the low speed cam 3 operates in an idle mode when the cam shaft 6 is rotated under the condition shown in FIG. 15 while the intermediate-high speed cams 4 and 5 drive the intake and exhaust valves 1 and 2 based upon the lift characteristic B in FIG. 8 by means of the intermediate-high speed rocker arms 8 and 9, respectively. As a result, the valves 1 and 2 open or close the combustion chamber while providing a valve lift which is suitable for the intermediate-high speed operating region of the engine.

According to the above described embodiment, a cam profile suitable for the low speed operation region of the engine is formed upon the low speed eam 3, a cam profile suitable for the intermediate-high speed operation region of the engine is formed upon the intermediate-high speed cams 4 and 5, the intermediate-high speed rocker arms 8 and 9 are mounted in a rotatable manner respectively upon the eccentric bushings 12 and 13 of the rocker shaft 11, the low speed rocker arm 7 is directly mounted upon the rocker shaft 11, it is possible by means of the rotation of the rocker shaft 11 to select a contact mode from either a first mode defined between the low speed cam 3 and the low speed rocker arm 7 and a second occurring respectively between the intermediate-high speed cams 4 and 5 and the intermediate-high rocker arms 8 and 9, whereby the valves 1 and 2 may thus be selectively driven by means of the low speed cam 3 or by means of the intermediate-hiqh speed cams 4 and 5. Therefore, it is possible to improve the output of a four-stroke cycle engine for a wide operating range extending from the low speed region to the intermediate-high speed region of the engine.

Moreover, since the selection between the low speed cam 3 and the intermediate-high speed cams 4 and 5 is performed by means of the rotation of the eccentric bushings 12 and 13, a large stress is not developed at each one of these portions when a selection is to be made between the cams 3, 4 and 5. Thus cams 3, 4 and 5 may be smoothly selected.

Furthermore, since the adjustment screws 33 and 34 are attached to the adjustment arms 31 and 32 respectively of the intermediate-high speed rocker arms 8 and 9 and the screw receiving portion 30 is formed upon the low speed rocker arm 7 in such a manner that a clearance is provided in an adjustable manner between the adjustment screws 33 and 34 and the screw receiving portion 30, the adjustment screws 33 and 34 may be caused to abut against the screw receiving portion 30 during the low speed operating region of the engine so as to synchronize the movement of the intermediate-high speed rocker arms 8 and 9 with the movement of the low speed rocker arm 7. As a result, the occurrence of striking noise during the low speed operation region of the engine as conventionally occurs between the intermediate-high speed rocker arms 8 and 9 and the intermediate-high speed cams 4 and 5 may be prevented.

Furthermore, since the striking noise during the low speed operation region of the engine and between the intermediate-high speed rocker arms 8 and 9 and the intermediate-high speed cams 4 and 5 is prevented, impacts upon these intermediate-high speed rocker arms 8 and 9 as well as upon the intermediate-high speed cams 4 and 5 may be reduced so as to improve the durability of the intermediate-high speed rocker arms 8 and 9 and the intermediate-high speed cams 4 and 5.

Figure 19:
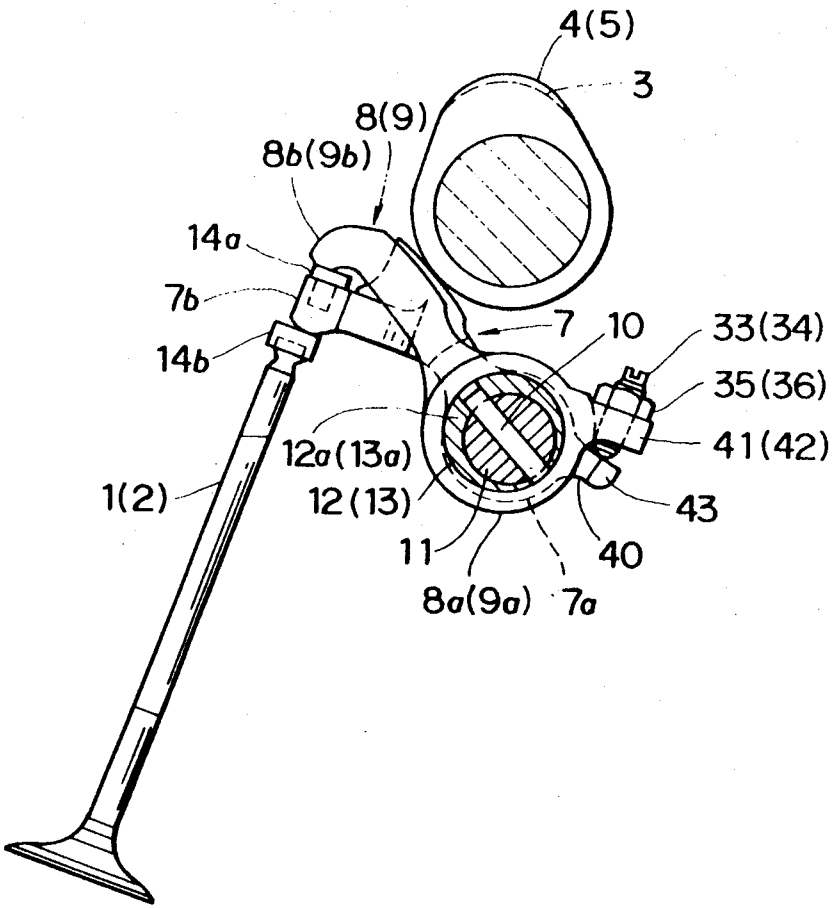
FIGS. 18 and 19 are plan and side views, respectively, showing a modified embodiment of the second embodiment of the valve actuating mechanism as disposed within a four-stroke cylinder engine.
Figure 18:
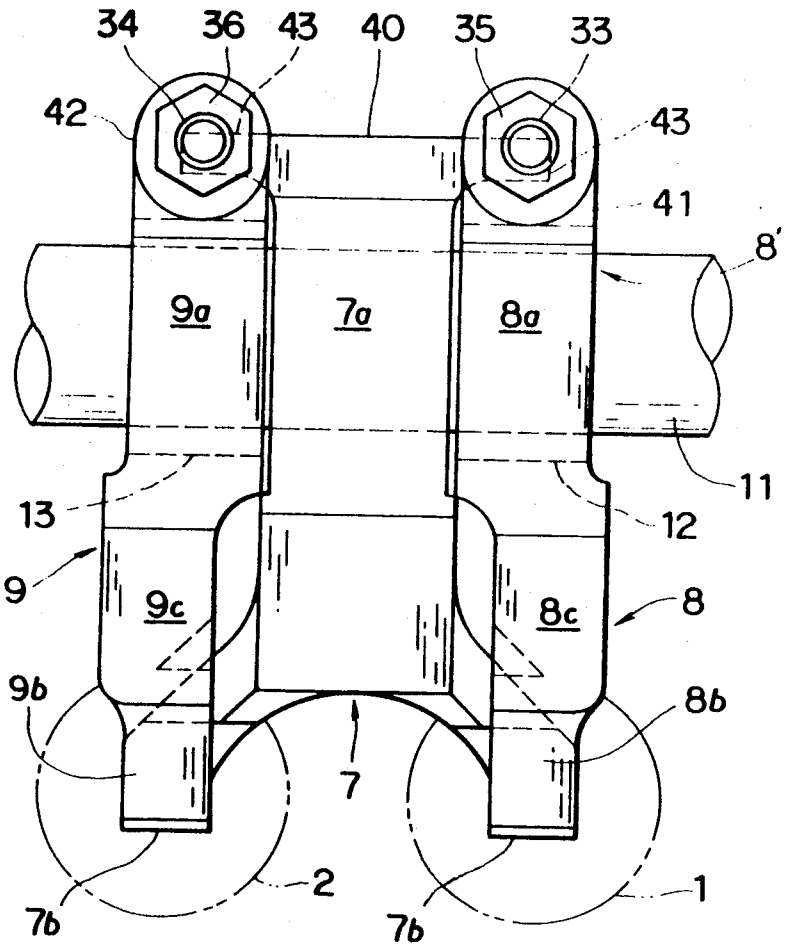

FIG. 18 and FIG. 19 are a plan view and a side view, respectively, showing a modified embodiment of a valve actuating mechanism within a four-stroke cycle engine according to the present invention. In this embodiment, those portions or elements which are similar to those in the above described second embodiment have been given the identical reference characters and their description will be abbreviated.

The supporting portions 8*a* and 9*a* of the intermediate-high speed rocker arms 8 and 9 are integrally formed with adjustment arms 41 and 42, respectively. These adjustment arms 41 and 42 are formed so as to extend in a straight line in the direction opposite to the distal end portions 8*b* and 9*b* with respect to the supporting portions 8*a* and 9*a*. Adjustment screws 33 and 34 are attached by means of screw threads to the adjustment arms 41 and 42, respectively. On the other hand, the supporting portion 7*a* of the low speed rocker arm 7 is integrally formed with a screw receiving portion 40. This screw receiving portion 40 is extended in the direction opposite to the branched end portion 7*b* with respect to the supporting portion 7*a*, and abutting portions 43 are formed upon both distal ends thereof. The abutting portions 43 are extended to a position directly beneath the adjustment screws 33 and 34.

Accordingly, since the clearance defined between the adjustment screws 33 and 34 and the abutting portions 43 of the screw receiving portion 40 may also be adjusted in this embodiment, the movement of the intermediate-high speed rocker arms 8 and 9 may be synchronized with the movement of the low speed rocker arm 7 during the low speed operating region of the engine. As a result, the floating state, that is, the play, of the intermediate-high speed rocker arms 8 and 9 may be prevented so as to prevent the occurrence of striking noise between the intermediate-high speed rocker arms 8 and 9 and the intermediate-high speed cams 4 and 5, and it is therefore possible to improve the durability of the intermediate-high speed rocker arms 8 and 9 and the intermediate-high speed cams 4 and 5.

Furthermore, since the adjust arms 41 and 42 are each simply extended as a straight line, the inertial weight of the intermediate-high speed rocker arms 8 and 9 may be reduced when compared to that of the above described first embodiment. As a result, the limit speed of the engine may be improved.

It is also to be noted that, as described with reference to the first embodiment, while the two embodiments as described above have been described with respect to the case where the cam profile of each intermediate-high speed cams 4 and 5 is one as indicated by means of the broken line B in FIG. 8, the cam profile of each intermediate-high speed cams 4 and 5 may be adapted so as to be one such as that indicated by means of the broken line B′ in FIG. 9 or by means of the broken line B″ in FIG. 10 so as to change the lift characteristics of the valves 1 and 2 during the intermediate-high speed operating range of the engine, as described with respect to the first embodiment.

Also, while the description of the above embodiments has been given with respect to the case where the hydraulic cylinder 15 has been used as the driving source for the rotation of the rocker shaft 11, a motor may be used as the driving source of rotation by using power transmission means such as, for example, a pulley and belt.

Furthermore, while the above two embodiments have been described with respect to the cases where the screw receiving portions 30 and 40 have been formed upon the supporting portion *7a* of the low speed rocker arm 7 and the adjustment arms 31 and 32, and 41 and 42 have been formed upon the supporting portions *8a* and *9a* of the intermediate-high speed rocker arms 8 and 9, respectively, the arrangement may be such that the adjustment arms 31 and 32 or 41 and 42 are formed upon the supporting portion *7a* of the low speed rocker arm 7 and the screw receiving portions 30 and 40.

As has been described, with a valve actuating mechanism for a four-stroke cycle engine constructed according to this invention, eccentric large-diameter portions are formed upon a rocker shaft which is supported in a rotatable manner, the second and third rocker arms are mounted upon the eccentric large-diameter portions, and a first rocker arm is located between the second and the third rocker arms and is mounted directly upon the rocker shaft. It is thus possible to improve the output of the engine for a wide speed region of operation by selecting the cams as described above through means of the rotation of the rocker shaft.

Also, since one of the supporting portions of the first rocker arm as described and the second and third rocker arms is provided with play adjusting screws thereon while the other supporting portion is formed with screw receiving portions so as to provide a clearance in an adjustable manner between the distal ends of the play adjusting screws and the screw receiving portions, the rocker arm which is not currently driven by means of its associated cam and is disposed in its floating state may be synchronized with the movement of the rocker arm which is being currently driven by means of its associated cam so as to prevent the occurrence of striking noise which is possibly caused between the rocker arm disposed in such floating state and the cam which is not driving the floating rocker arm.

Obviously, many modifications and variations of the present invention are possible in light of the above teachings. It is therefore to be understood that within the scope of the appended calims, the present invention may be practiced otherwise than as specifically described herein.

What is claimed is:

1. A valve actuating mechanism disposed within a four-stroke cycle engine within which exhaust and intake valves are disposed, comprising:

a rocker shaft rotatably supported within a cylinder head of an engine and having eccentric large-diameter portions formed upon said rocker shaft;

rocker arm means including a first rocker arm rotatably mounted directly upon said rocker shaft, and second and third rocker arms rotatably mounted upon said eccentric large-diameter portions of said rocker shaft with said first rocker arm being interposed between said second and third rocker arms;

cam means including first, second, and third cam members which drive said first, second, and third rocker arms, respectively;

said first rocker arm being provided with a branched distal end, and said second and third rocker arms each being provided with a distal end which is respectively disposed upon one of said distal end of said branched distal end of said first rocker arm;

said second and third cams having the same cam profile while said first cam has a cam profile which is different from said profile of said second and third cams; and means for rotating said rocker shaft such that axes of said eccentric large-diameter portions of said rocker shaft are always moved within one-half side of said rocker shaft between a diagonally inward limit position at which said first cam drives said first rocker arm, and a diagonally outward limit position at which said second and third cams drive said second and third rocker arms, said diagonally outward limit position being disposed at a position which is angularly disposed beyond dead points of said eccentric large-diameter portions of said rocker shaft.

2. A valve actuating mechanism according to claim 1, wherein said first rocker arm and said first cam are located for a low speed operation and said second and third rocker arms and second and third cams are located for an intermediate-high speed operation.

3. A valve actuating mechanism according to claim 1, wherein the distal ends of said second and third rocker arms abut against the branched distal ends of said first rocker arm through means of shims.

4. A valve actuating mechanism according to claim 1, wherein said branched distal ends of said first rocker arm are operatively connected to said exhaust and intake valves disposed in the engine.

5. A valve actuating mechanism as set forth in claim 1, wherein said means for rotating said rocker shaft comprises:

a driving mechanism connected to one end of said rocker shaft and comprising a drive means, a rack member operatively connected to said drive means, and a pinion member formed upon said one end of said rocker shaft so as to be engageable with said rack member.

6. A valve actuating mechanism as set forth in claim 5, wherein said drive means comprises a hydraulic cylinder-piston mechanism.

7. A valve actuating mechanism as set forth in claim 5, further comprising:

stopper means for defining said diagonally inward and diagonally outward limit positions and comprising a stopper screw fixedly mounted within said cylinder head of said engine, and a stopper groove formed within a peripheral portion of said rocker shaft, located at an end of said rocker shaft which is disposed opposite said one end of said rocker shaft upon which said pinion member is formed, for engagement with said stopper screw of said cylinder head.

8. A valve actuating mechanism disposed within a four-stroke cycle engine within which exhaust and intake valves are disposed, comprising:

a rocker shaft rotatably supported within a cylinder head of an engine and having eccentric large-diameter portions formed upon said rocker shaft;

rocker arm means including a first rocker arm rotatably mounted directly upon said rocker shaft, and second and third rocker arms rotatably mounted upon said eccentric large-diameter portions of said rocker shaft with said first rocker arm being interposed between said second and third rocker arms;

cam means including first, second, and third cam members which drive said first, second, and third rocker arms, respectively;

said first rocker arm being provided with a branched distal end, and said second and third rocker arms each being provided with a distal end which is respectively disposed upon one fo said distal ends of said branched distal end of said first rocker arm;

said second and third rocker arms having the same cam profile while said first cam has a cam profile which is different from said cam profile of said second and third cams; and said eccentric large-diameter portions of said rocker shaft comprising eccentric busings each having a diameter which is larger than the diameter of said rocker shaft, said eccentric bushings having axial centers disposed eccentrically with respect to the axial center of said rocker shaft, and said eccentric bushings being secured to said rocker shaft by means of a stopper pin.

9. A valve actuating mechanicm disposed within a four-stroke cycle engine within which xhaust and intake valves are disposed, comprising:

a rocker shaft rotatably supported within a cylinder head of an engine and having eccentric large-diameter portions formed upon said rocker shaft;

rocker arm means including a first rocker arm rotatably mounted directly upon said rocker shaft, and second and third rocker arms rotatably mounted upon said eccentric large-diameter portions of said rocker shaft with said first rocker arm being interposed between said second and third rocker arms, said first, second, and third rocker arms being provided with support portions respectively mounted upon said rocker shaft;

cam means including first, second, and third cam members which drive said first, second, and third rocker arms, respectively;

said first rocker arm being provided with a branched distal end, and said second and third rocker arms each being provided with a distal end which is respectively disposed upon one fo said distal ends of said branched distal end of said first rocker arm;

said second and third rocker arms having the same cam profile while said first cam has a cam profile which is different from said profile of said second and third cams;

play adjusting screw means disposed upon one of said support portions of said first rocker arms, and said second and third rocker arms; and a screw receiving portion disposed upon an opposite one of said support portions of said first rocker arm, and said second and third rocker arms, with rsepect to said one of said support portions of said first rocker arm, and said second and third rocker arms, upon which said play adjusting screw means is disposed so as to define with said play adjusting screw means a clearance which is adjustable.

10. A valve actuating mechanism according to claim 9, wherein said play adjusting screw means is provided upon each of the support portions of said second and third rocker arms and the screw receiving portion is provided upon the support portion of said first rocker arm.

11. A valve actuating mechanism according to claim 9, wherein said play adjusting screw means comprises and adjustment arm integrally formed with the support portion of said one of said first rocker arm, and said second and third rocker arms so as to extend in a direction away from said integrally formed support portion towards the scre receiving portion, and adjusting screw threadedly engaged within a distal end portion of the adjustment arm and a nut engaged with the adjusting screw.

12. A valve actuating mechanism disposed within a four-stroke cycle engine within which exhaust and intake valves are disposed, comprising:

a rocker shaft rotatably supported within a cylinder head of an engine and having eccentric large-diameter portions formed upon said rocker shaft, and pin insertion hole being defined within said rocker shaft;

rocker arm means including a first rocker arm rotatably mounted directly upon said rocker shaft, and second and third rocker arms rotatably mounted upon said eccentric large-diameter portions of said rocker shaft with said first rocker arm being interposed between said second and third rocker arms; and cam means including first, second, and third cam members which drive said first, second, and third rocker arms, respectively;

said second and third cams having the same cam profile while said first cam has a cam profile which is different from said cam profile of said second and third cams;

said eccentric large-diameter portions of said rocker shaft each comprising an eccentric bushing having a thick-walled top portion and a pin insertion hole formed within said thick-walled top portion such that said stopper pin can be inserted into said pin insertion holes of said eccentric bushing and said rocker shaft so as to maintain said thick-walled top portion of said bushing at a position disposed upon one half side of said rocker shaft while said rocker shaft is rotated.

13. A valve actuating mechanism according to claim 12, further comprising:

means for rotating said rocker shaft such that axes of said eccentric bushings of said rocker shaft are always moved within said one half side of said rocker shaft between a diagonally inward limit position at which said first cam drives said first rocker arm, and a diagonally outward limit position at which said second and third cams drive said second and third rocker arms, said diagonally outward limit position being disposed at a position which is angularly disposed beyond dead points of said eccentric large-diameter bushing portions of said rocker shaft.

14. A valve actuating mechanism according to claim 12, wherein said first rocker arm and said first cam are located for a low speed operation, and said second and third rocker arms and said second and third cams are located for an intermediate-high speed operation.

15. A valve actuating mechanism according to claim 12, wherein said first, second and third rocker arms are provided with support portions, respectively, mounted on said rocker shaft.

16. A valve actuating mechanism according to claim 12, wherein distal ends of said second and third rocker arms abut against the branched distal ends of said first rocker arm through means of shims.

17. A valve actuating mechanism according to claim 16, wherein said branched distla ends of said first rocker arm are operatively connected to said exhaust and intake valves disposed in the engine.

18. A valve actuating mechanism as set forth in claim 13, wherein said means for rotating said rocker shaft comprises:

a driving mechanism connected to one end of said rocker shaft and comprising a drive means, a rack member operatively connected to said drive means, and a pinion member formed upon said one end of said rocker shaft so as to be engageable with said rack member.

19. A valve actuating mechanism as set forth in claim 18, wherein:

said drive means comprises a hydraulic cylinder-piston mechanism.

20. A valve actuating mechanism as set forth in claim 18, further comprising:

stopper means for defining said diagonally inward and diagonally outward limit positions and comprising a stopper screw fixedly mounted within said cylinder head of said engine, and a stopper groove formed within a peripheral portion of said rocker shaft, located at an end of said rocker shaft which is disposed opposite said one end of said rocker shaft upon which said pinion member is formed, for engagement with said stopper screw of said cylinder head.

* * * * *

UNITED STATES PATENT AND TRADEMARK OFFICE

CERTIFICATE OF CORRECTION

PATENT NO. : 5,148,783

DATED : September 22, 1992

INVENTOR(S) : TATSUYA SHINKAI ET AL.

It is certified that error appears in the above-identified patent and that said Letters Patent is hereby corrected as shown below:

Claim 1, column 17, line 65, change "end" to --ends--.

Claim 8, column 19, line 4, change "fo" to --of--; and line 11, change "busings" to --bushings--.

Claim 9, column 19, line 18, change "mechanicm" to --mechanism--;

line 19, change "xhaust" to --exhaust--; and line 39, change "fo" to --of--.

Claim 11, column 19, line 64, change "and" to --an--; and line 68, change "scre" to --screw--, and change "and" to --an--.

Claim 12, column 20, line 9, change "and" to --a--.

Claim 17, column 20, line 66, change "distla" to --distal--.

UNITED STATES PATENT AND TRADEMARK OFFICE

CERTIFICATE OF CORRECTION

PATENT NO. : 5,148,783

DATED : September 22, 1992

INVENTOR(S) : TATSUYA SHINKAI ET AL.

It is certified that error appears in the above-identified patent and that said Letters Patent is hereby corrected as shown below:

In the Abstract, line 24, change "defiend" to --defined--;

Signed and Sealed this

Ninth Day of November, 1993

*Attest:*

*Attesting Officer*

BRUCE LEHMAN

*Commissioner of Patents and Trademarks*